US010606208B2

(12) United States Patent
Saito et al.

(10) Patent No.: US 10,606,208 B2
(45) Date of Patent: Mar. 31, 2020

(54) DEVELOPER CONTAINER, IMAGE FORMATION UNIT, AND IMAGE FORMATION APPARATUS

(71) Applicant: Oki Data Corporation, Tokyo (JP)

(72) Inventors: Hisatoshi Saito, Tokyo (JP); Tetsu Koyama, Tokyo (JP); Masashi Fujii, Tokyo (JP); Shun Hatanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/133,857

(22) Filed: Sep. 18, 2018

(65) Prior Publication Data

US 2019/0094786 A1 Mar. 28, 2019

(30) Foreign Application Priority Data

Sep. 26, 2017 (JP) ..... 2017-184661
Dec. 21, 2017 (JP) ..... 2017-244933
Mar. 27, 2018 (JP) ..... 2018-59689

(51) Int. Cl.
*G03G 21/00* (2006.01)
*G03G 15/00* (2006.01)
*G03G 15/08* (2006.01)

(52) U.S. Cl.
CPC ..... *G03G 21/0029* (2013.01); *G03G 15/0862* (2013.01); *G03G 15/0865* (2013.01); *G03G 15/80* (2013.01)

(58) Field of Classification Search
CPC ..... G03G 15/0862; G03G 15/0865; G03G 15/80; G03G 21/0029
See application file for complete search history.

(56) References Cited

U.S. PATENT DOCUMENTS

2007/0147857 A1* 6/2007 Shin ..... G03G 15/0856 399/27
2012/0189326 A1* 7/2012 Yoshida ..... G03G 15/0856 399/27
2012/0189327 A1* 7/2012 Kubota ..... G03G 15/0893 399/27
2015/0132018 A1* 5/2015 Sakaya ..... G03G 15/0862 399/27
2018/0253027 A1* 9/2018 Tanaka ..... G03G 15/0891

FOREIGN PATENT DOCUMENTS

JP 2009-288304 A 12/2009

* cited by examiner

*Primary Examiner* — Francis C Gray
(74) *Attorney, Agent, or Firm* — Metrolex IP Law Group, PLLC

(57) ABSTRACT

A developer container according to an embodiment includes: a container having a space that contains a developer; an optical system includes a first optical member including first end face exposed to a containing space in the container and a second optical member including a second end face exposed to the containing space and being opposed to the first end face in a first direction, and on which the light is incident through the second end face; a shaft provided in the containing space to be rotatable about the first direction; a cleaning member provided to the shaft to be movable in the first direction to clean the first and second end faces by passing through a gap with a rotation of the shaft; and a guide member provided upstream of the optical system and that comes into contact with the cleaning member to guide the cleaning member to a gap.

21 Claims, 24 Drawing Sheets

DEVELOPER CONTAINER, IMAGE FORMATION UNIT, AND IMAGE FORMATION APPARATUS

CROSS REFERENCE TO RELATED APPLICATIONS

This application claims priority based on 35 USC 119 from prior Japanese Patent Application No. 2017-184661 filed on Sep. 26, 2017, entitled "DEVELOPER CONTAINER, IMAGE FORMATION UNIT, AND IMAGE FORMATION APPARATUS", Japanese Patent Application No. 2017-244933 filed on Dec. 21, 2017, entitled "DEVELOPER CONTAINER, IMAGE FORMATION UNIT, AND IMAGE FORMATION APPARATUS" and Japanese Patent Application No. 2018-059689 filed on Mar. 27, 2018, entitled "DEVELOPER CONTAINER, IMAGE FORMATION UNIT, AND IMAGE FORMATION APPARATUS", the entire contents of which are incorporated herein by reference.

BACKGROUND

The disclosure relates to a developer container that contains a developer, an image formation unit that contains the developer, and an image formation apparatus.

In an image formation apparatus, a quantity of the remaining developer is often detected. For example, Japanese Patent Application Publication No. 2009-288304 discloses an image formation apparatus in which a quantity of the remaining developer in a process cartridge is detected using light.

Patent Document 1: Japanese Patent Application Publication No. 2009-288304

The image formation apparatus is desired to achieve high the detection accuracy in detection of the quantity of the remaining developer, and is expected to further improve in the detection accuracy.

Therefore, it is desirable to provide a developer container, an image formation unit, and an image formation apparatus that are capable of enhancing the detection accuracy in detection of the quantity of the remaining developer.

SUMMARY

A developer container according to a first aspect may include a container defining therein a space containing a developer; an optical system that includes a first optical member which includes a first end face exposed to the containing space in the container, and from which light is emitted through the first end face, and a second optical member which includes a second end face exposed to the containing space and being opposed to the first end face in a first direction, and on which the light is incident through the second end face; a shaft that is provided in the containing space, and that is rotatable about a rotation axis extending along the first direction; a cleaning member that is provided to the shaft, and that is movable in the first direction, and cleans the first end face and the second end face by passing through a gap between the first end face and the second end face with a rotation of the shaft; and a guide member that is provided upstream of the optical system in a rotation direction of the shaft, and that comes into contact with the cleaning member to guide the cleaning member to the gap.

A developer container according to a second aspect may include a container defining therein a space containing a developer; an optical system that includes a first optical member which includes a first end face exposed to a containing space in the container, and from which light is emitted through the first end face, and a second optical member which includes a second end face exposed to the containing space, and being opposed to the first end face in a first direction, and on which the light is incident through the second end face; a shaft that is provided in the containing space, and that is rotatable about a rotation axis extending to the first direction; a cleaning member that is provided to the shaft, that includes a first oblique surface and a second oblique surface being inclined with respect to the first direction while extending in opposite directions, and that cleans the first end face and the second end face by passing through a gap between the first end face and the second end face with a rotation of the shaft.

An image formation unit according to a first aspect may include the developer container as described above, and a development section that forms an image by using the developer contained in the container.

An image formation unit according to a second aspect may include the image formation unit as described above, a light emitter that emits the light to be ejected from the first end face of the first optical member; a light detector that detects the light incident on the second optical member; and a developer detector that detects, based on a detection result by the light detector, a quantity of the developer contained in the container.

DETAILED DESCRIPTION

Figure 1:
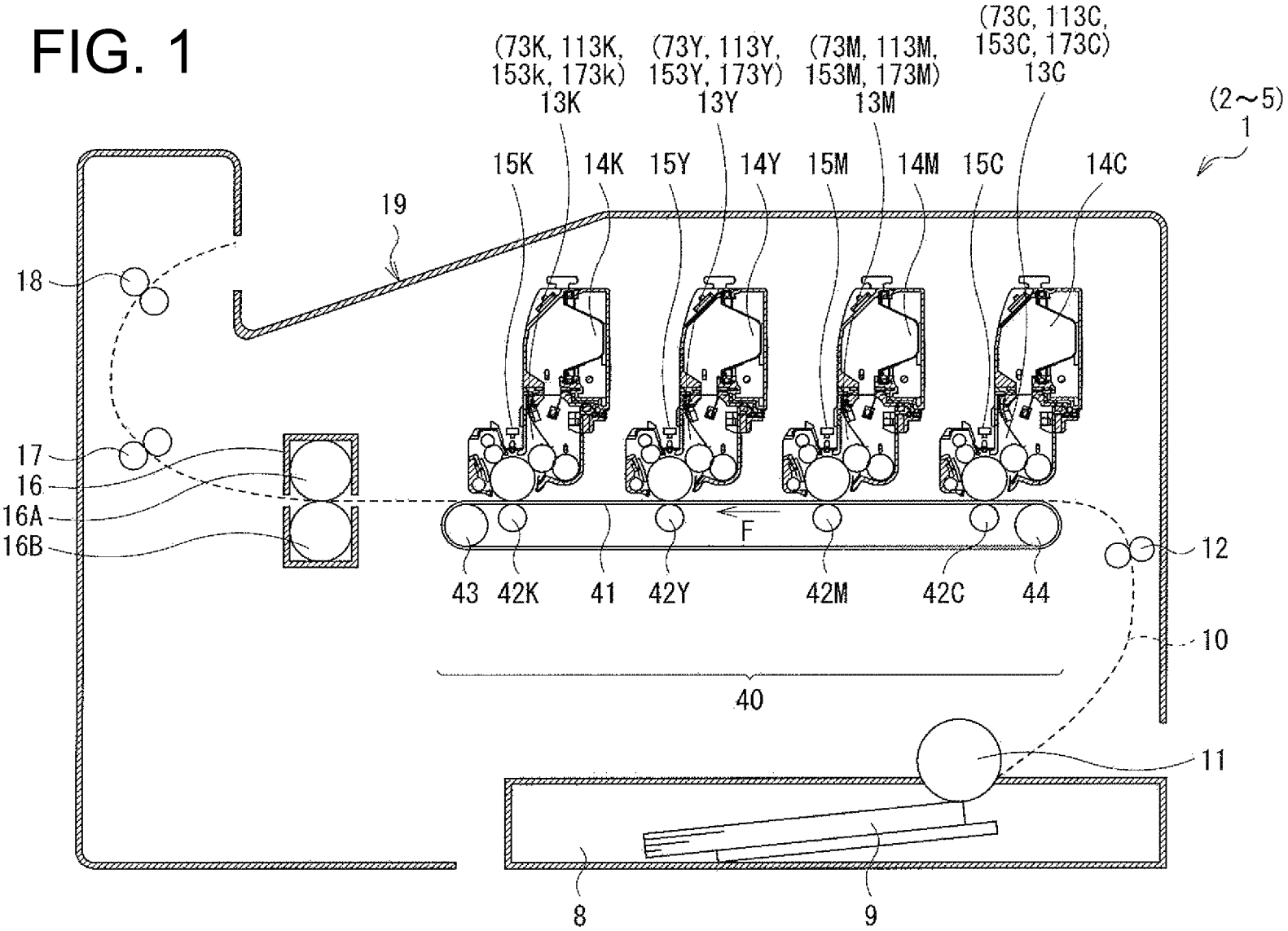
FIG. 1 is a configuration diagram illustrating one configuration example of an image formation apparatus according to a first embodiment.

Embodiments are explained with referring to drawings. In the respective drawings referenced herein, the same constitutions are designated by the same reference numerals and duplicate explanation concerning the same constitutions is basically omitted. All of the drawings are provided to illustrate the respective examples only.

Hereinafter, embodiments of the disclosure are explained in details with reference to the drawings. It should be noted that explanations are made in the following order.

1. First embodiment (example using a plate-like wiping member)
2. Second embodiment (example using a plate-like wiping member)
3. Third embodiment (example using a V-shaped wiping member)
4. Fourth embodiment (example using a V-shaped wiping member)
5. Fifth embodiment (example of transmission of a power to a wiping member)

1. First Embodiment

Configuration Example

FIG. 1 illustrates one configuration example of an image formation apparatus (image formation apparatus 1) according to one embodiment of the disclosure. The image formation apparatus 1 functions as a printer that forms an image on a recording medium including plain paper and the like using the electrophotographic printing method, for example. The image formation apparatus 1 is provided with a medium feed roller 11, a registration roller pair 12, four image formation units 13 (image formation units 13C, 13M, 13Y, and 13K), four toner containers 14 (toner containers 14C, 14M, 14Y, and 14K), four exposure heads 15 (exposure heads 15C, 15M, 15Y, and 15K), a transfer section 40, a fixation section 16, a conveyance roller pair 17, and a discharge roller pair 18. These members are placed along a conveyance path 10 that conveys a recording medium 9.

The medium feed roller 11 serves as a member that picks up one by one recording media 9 stored in a medium storage section 8 from the uppermost part, and sends out (transfer) the picked-up recording medium 9 to the conveyance path 10.

The registration roller pair 12 serves as a member that includes a pair of rollers between which the conveyance path 10 is sandwiched, and that corrects an angle of a skew of the recording medium 9 supplied from the medium feed roller 11, and conveys the recording medium 9 along the conveyance path 10.

The four image formation units 13 respectively form toner images onto the recording medium 9. Specifically, the image formation unit 13C forms a toner image of cyan color (C), the image formation unit 13M forms a toner image of magenta color (M), the image formation unit 13Y forms a toner image of yellow color (Y), and the image formation unit 13K forms a toner image of black color (K). In this example, the four image formation units 13 are placed in the order of the image formation units 13C, 13M, 13Y, and 13K in a conveyance direction F of the recording medium 9. Each image formation unit 13 is configured to be removable from the image formation apparatus 1.

The four toner containers 14 each contains toner. Specifically, the toner container 14C contains toner of cyan color, the toner container 14M contains toner of magenta color, the toner container 14Y contains toner of yellow color, and the toner container 14K contains toner of black color. The four toner containers 14 are configured to be removable from the corresponding four image formation units 13, respectively.

Figure 2:
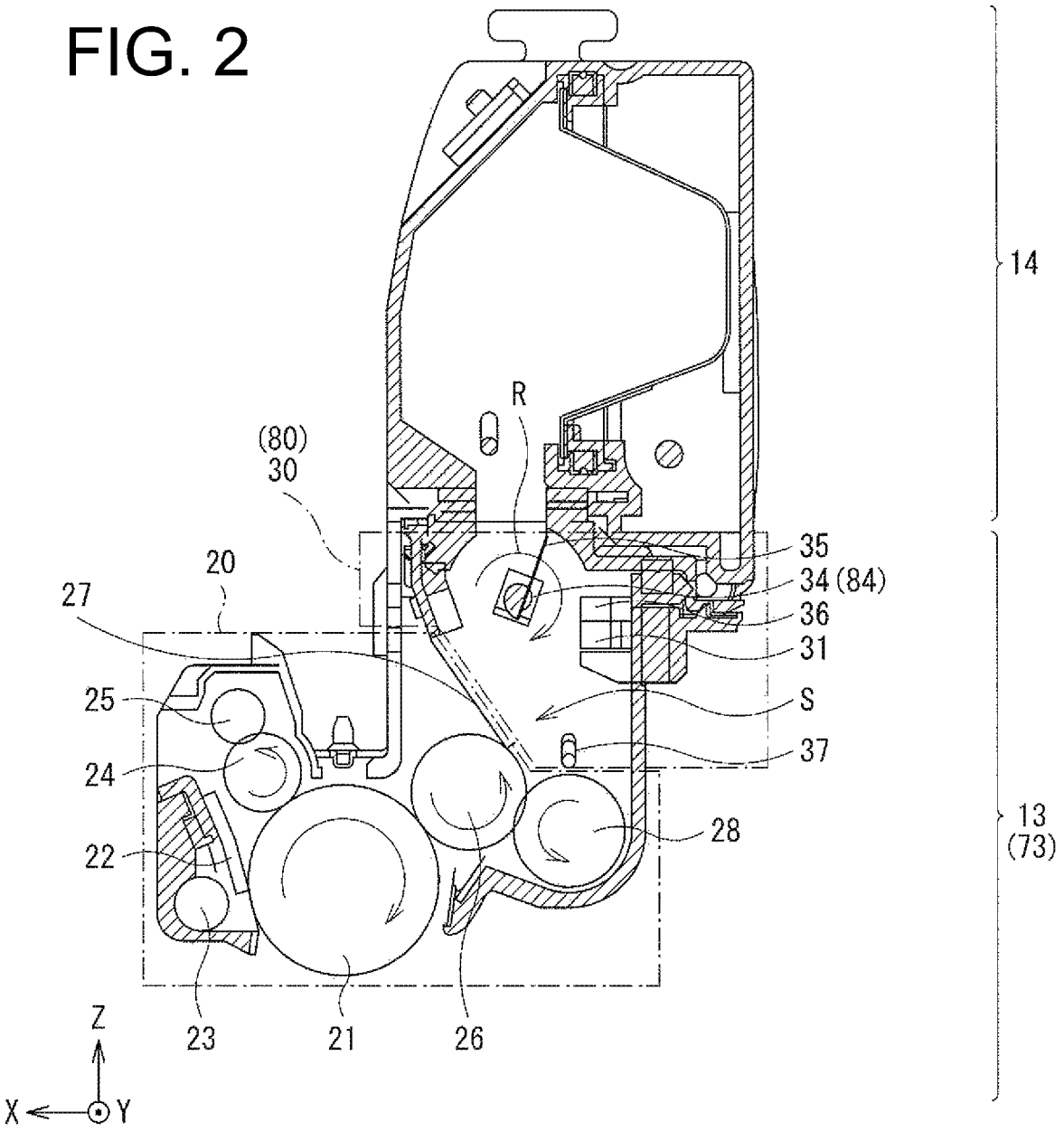
FIG. 2 is a configuration diagram illustrating one configuration example of an image formation unit illustrated in FIG. 1.

FIG. 2 illustrates one configuration example of the image formation unit 13. It should be noted that FIG. 2 also illustrates the toner container 14. The image formation unit 13 includes a development section 20, and a toner storage section 30.

The development section 20 develops an image on the recording medium 9. The development section 20 includes a photoconductive drum 21, a cleaning blade 22, a charge roller 24, an auxiliary roller 25, a development roller 26, a development blade 27, and a supply roller 28.

The photoconductive drum 21 serves as a member that supports an electrostatic latent image on a surface (surface layer) thereof. The photoconductive drum 21 rotates in a clockwise direction in this example, by a power transmitted from a drum motor, which is not illustrated. The photoconductive drum 21 is electrically charged by the charge roller 24, and is exposed to light by the exposure head 15. Specifically, the photoconductive drum 21 of the image formation unit 13C is exposed to light by the exposure head 15C, the photoconductive drum 21 of the image formation unit 13M is exposed to light by the exposure head 15M, the photoconductive drum 21 of the image formation unit 13Y is exposed to light by the exposure head 15Y, and the photoconductive drum 21 of the image formation unit 13K is exposed to light by the exposure head 15K. This forms an electrostatic latent image on a surface of each photoconductive drum 21. Further, the development roller 26 supplies toner to the photoconductive drum 21 to form a toner image in accordance with the electrostatic latent image on the photoconductive drum 21.

The cleaning blade 22 serves as a member that scrapes off toner remaining on a surface (surface layer) of the photoconductive drum 21, thereby cleaning the photoconductive drum 21. Further, the scraped-off toner is conveyed by a conveyance spiral 23, and is contained into, for example, a waste toner box (not illustrated) provided in the toner container 14.

The charge roller 24 serves as a member that electrically charges the surface (surface layer) of the photoconductive drum 21. The charge roller 24 is placed in contact with a surface (peripheral surface) of the photoconductive drum 21, and is placed to be pressed against the photoconductive drum 21 by a predetermined press amount (amount of pressing force). The charge roller 24 rotates in a counter-clockwise direction in this example, along with the rotation of the photoconductive drum 21. The charge roller 24 is applied with a charge voltage by a voltage controller 57, which is described later.

The auxiliary roller 25 serves as a member that cleans the surface of the charge roller 24. The auxiliary roller 25 is placed in contact with the surface (peripheral surface) of the charge roller 24, and is placed to be pressed against the charge roller 24 by a predetermined pressing force. The auxiliary roller 25 rotates in a clockwise direction in this example, by a power transmitted from the drum motor, which is not illustrated.

The development roller 26 serves as a member that supports toner on a surface thereof. The development roller 26 is placed in contact with the surface (peripheral surface) of the photoconductive drum 21, and is placed to be pressed against the photoconductive drum 21 by a predetermined press amount. The development roller 26 rotates in a counter-clockwise direction in this example, by a power transmitted from the drum motor, which is not illustrated. The voltage controller 57, which is described later, applies a development voltage to the development roller 26.

The development blade 27 serves as a member that abuts on and contact the surface of the development roller 26, thereby causing a layer (toner layer) including toner to be formed on the surface of the development roller 26, and regulating (controlling, adjusting) the thickness of the toner layer. The development blade 27 is obtained by bending a plate-like elastic member made of stainless steel and the like in an L-character shape, for example. The development blade 27 is placed such that the bent portion thereof abuts on the surface of the development roller 26, and is placed to be pressed against the development roller 26 by a predetermined press amount.

The supply roller 28 serves as a member that supplies toner stored in the toner storage 30 to the development roller 26. The supply roller 28 is placed in contact with a surface (circumference surface) of the development roller 26, and is placed to be pressed against the development roller 26 by a predetermined press amount. The supply roller 28 rotates in a counter-clockwise direction in this example, by a power transmitted from the drum motor, which is not illustrated. This generates friction between the surface of the supply roller 28 and the surface of the development roller 26 in each image formation unit 13. As a result, in each image formation unit 13, toner is electrically charged by what is called a friction charge. The voltage controller 57 (which is described later) applies a supply voltage to the supply roller 28.

The toner storage 30 temporarily stores therein toner supplied from the toner container 14. The toner storage 30 includes a light-guide part 31, a shaft 34, a wiping member 35, a guide member 36, and a stirring bar 37.

Figure 3:
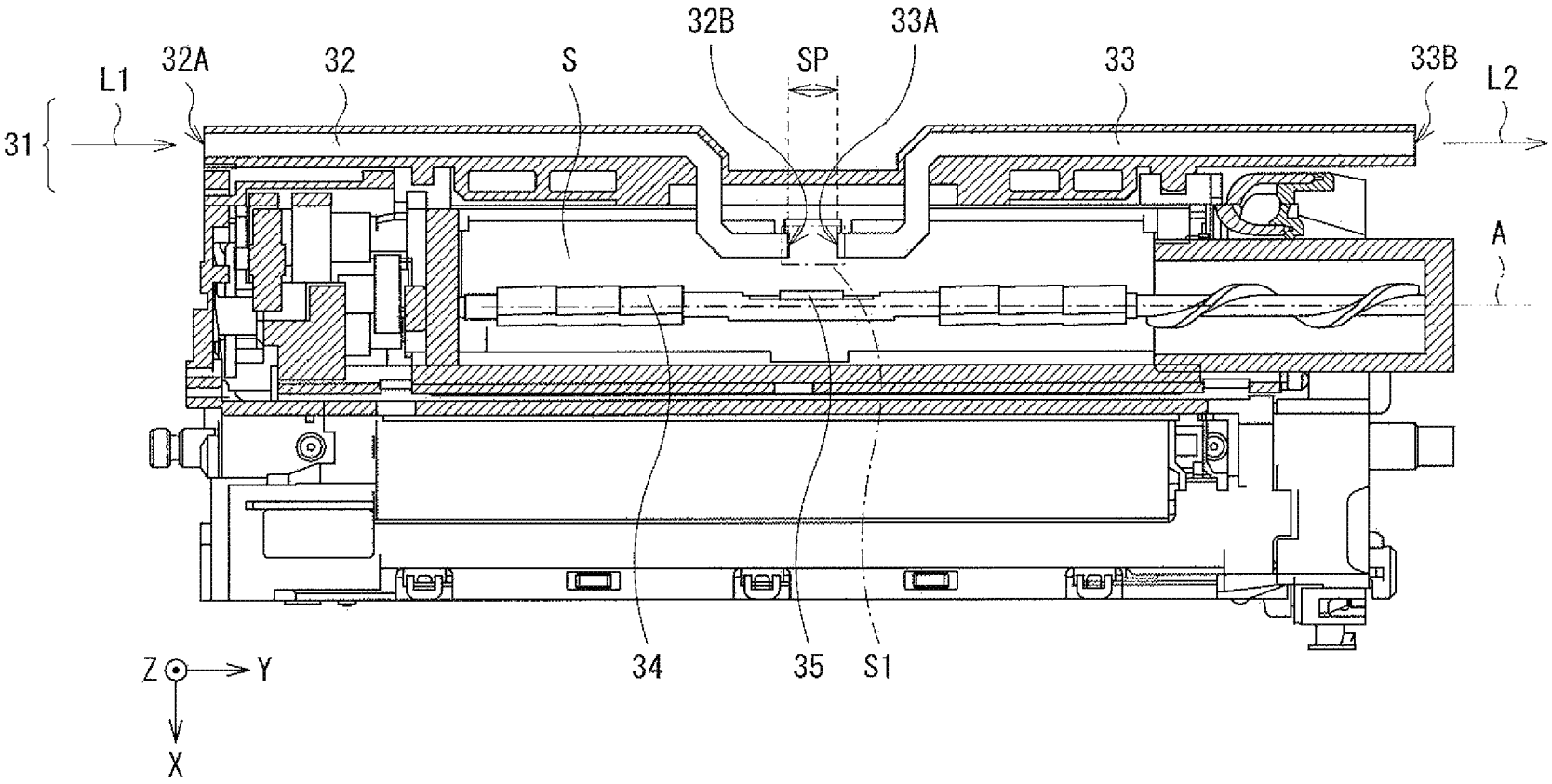
FIG. 3 is a configuration diagram illustrating one configuration example of a toner storage section illustrated in FIG. 2.
Figure 4:
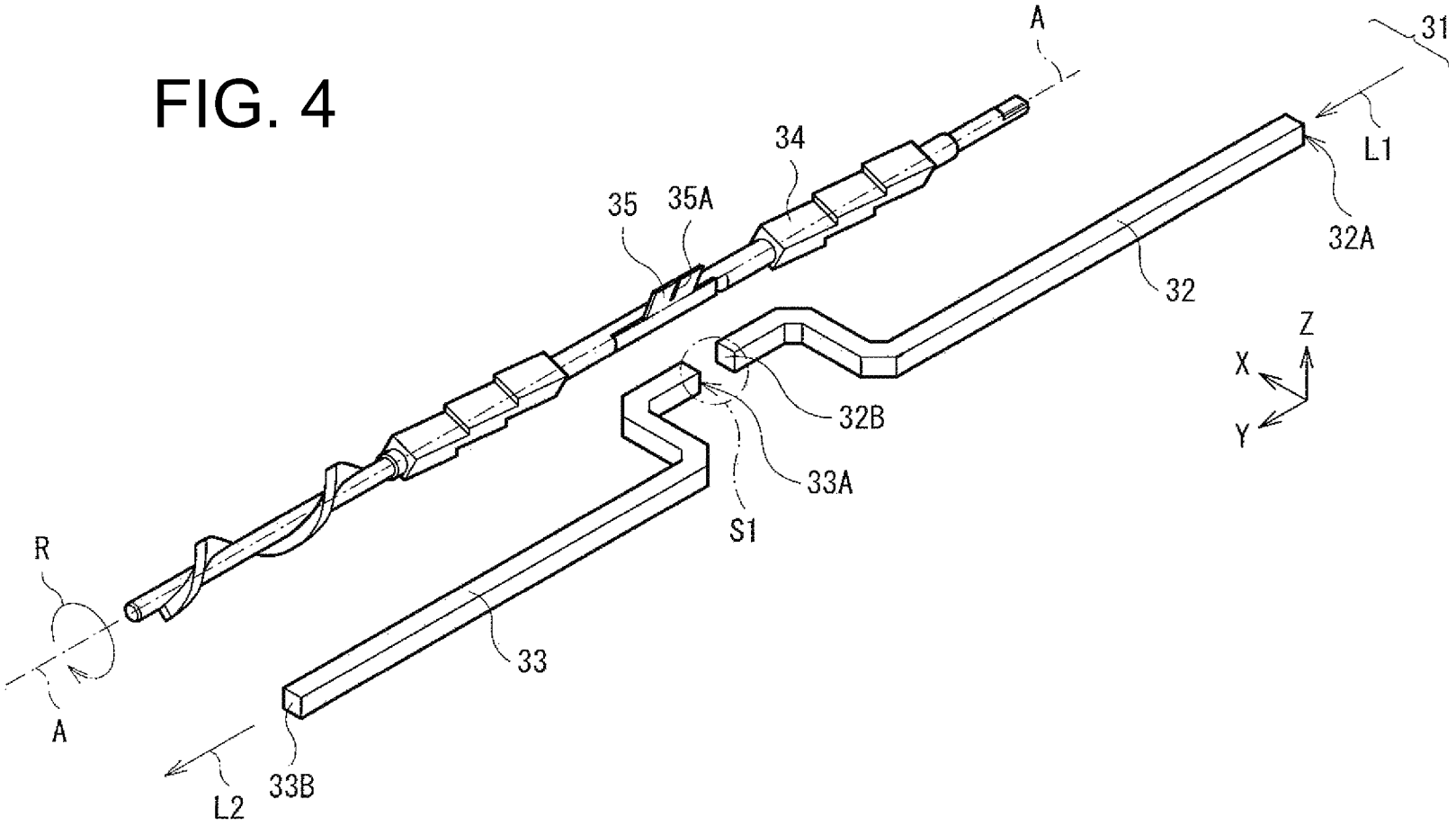
FIG. 4 is a perspective view illustrating one configuration example of a wiping member and a light-guide part illustrated in FIG. 2.
Figure 5:
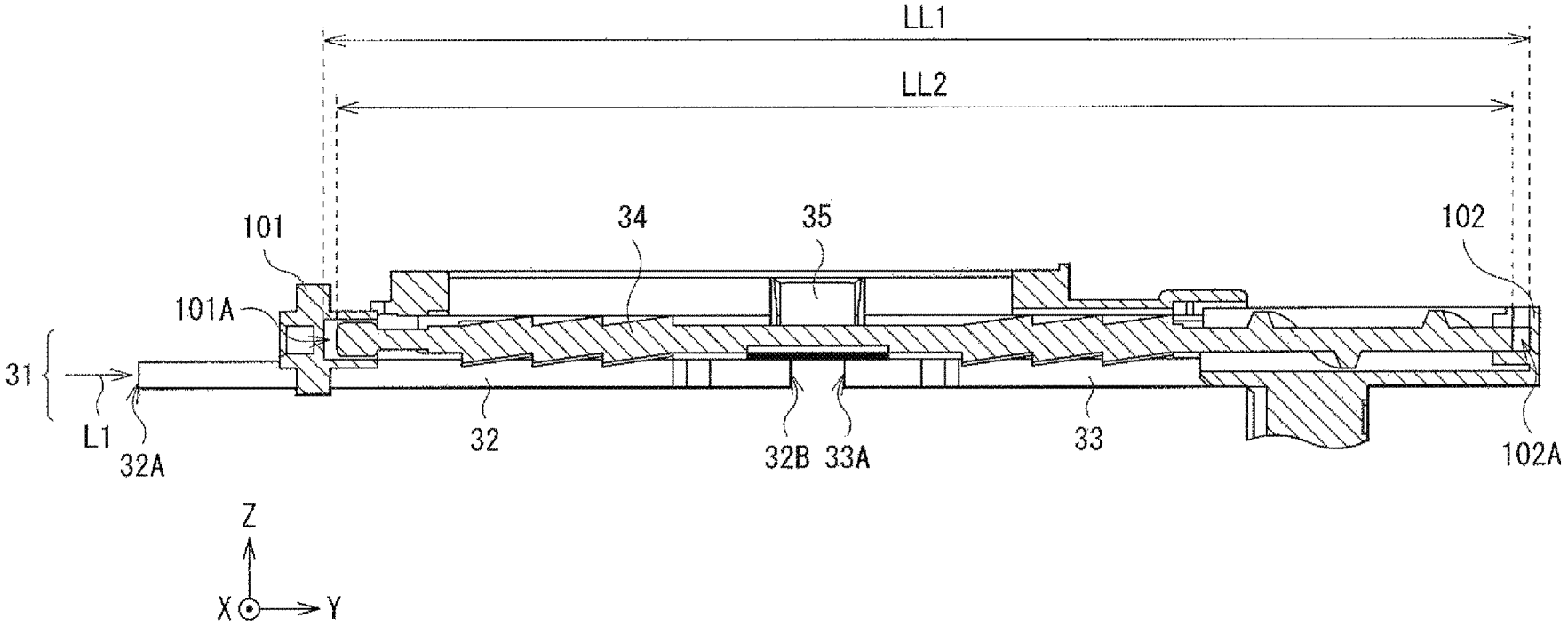
FIG. 5 is a configuration diagram illustrating one implementation example of a shaft according to a first embodiment.
Figure 6:
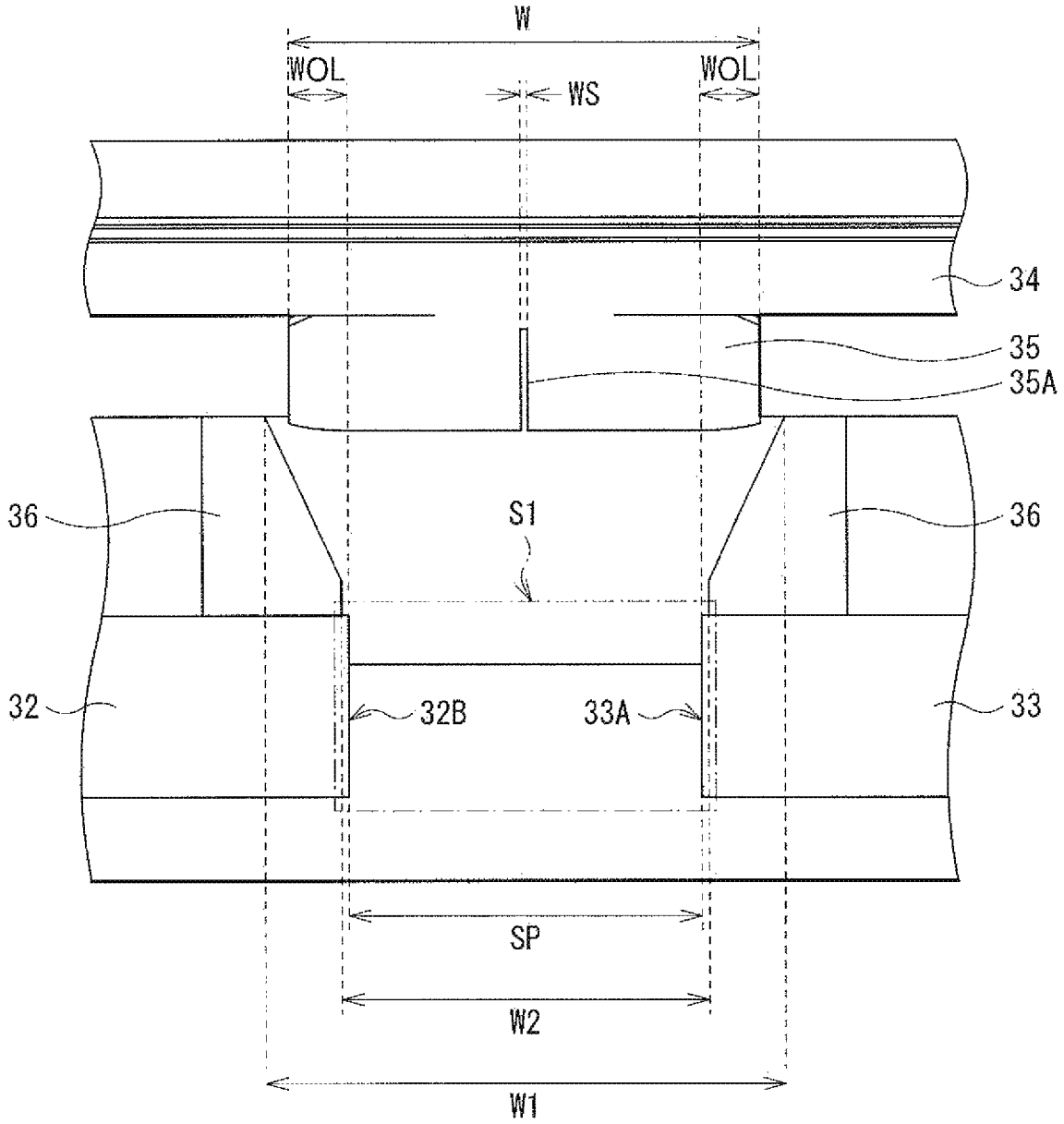
FIG. 6 is a configuration diagram illustrating one configuration example of a guide member illustrated in FIG. 2.

FIG. 3 illustrates one configuration example of the toner storage 30. FIG. 4 illustrates one configuration example of the shaft 34, the wiping member 35, and the light-guide part 31. FIG. 5 illustrates an implementation example of the shaft 34. FIG. 6 illustrates one configuration example of the guide member 36.

The light-guide part 31 guides light emitted from a light source such as a light-emitting diode. The light-guide part 31 includes light-guide lenses 32 and 33, as illustrated in FIGS. 3 and 4.

The light-guide lens 32 serves as a member that guides light L1 incident on one end to the other end. The light-guide lens 32 includes an end face 32A and an end face 32B. The end face 32A is provided at one end of the light-guide lens 32, and the light L1 emitted from a light emitter 61, which is described later, is incident on the light-guide lens 32 through the end face 32A. The end face 32B is provided at the other end of the light-guide lens 32, and the light L1 guided by the light-guide lens 32 is emitted through the end face 32B. The other end of the light-guide lens 32 is provided in a storage space S in which toner is stored in the toner storage 30, and the end face 32B is exposed to the storage space S.

The light-guide lens 33 serves as a member that guides light L2 from one end to the other end. The light-guide lens 33 includes an end face 33A and an end face 33B. The end face 33A is provided at one end of the light-guide lens 33, and the light L2 is incident on the light-guide lens 33 through the end face 33A. The end face 33B is provided at the other end of the light-guide lens 33, and the light L2 guided by the light-guide lens 33 is emitted through the end face 33B. The light L2 is detected by a light detector 62, which is described later. One end of the light-guide lens 33 is provided in the storage space S, and the end face 33A is exposed to the storage space S.

The end face 32B of the light-guide lens 32 and the end face 33A of the light-guide lens 33 are provided to be apart from and opposed to each other in a Y-axis direction (longitudinal direction of the shaft 34). A distance (lens interval SP) between the end face 32B and the end face 33A is set to 6 mm, for example.

With this configuration, in the light-guide 31, the light L1 is incident on the light-guide lens 32 through the end face 32A, is guided by the light-guide lens 32, and is emitted through the end face 32B. For example, part of the light L1 is blocked by toner in a clearance (gap S1) between the end face 32B of the light-guide lens 32 and the end face 33A of the light-guide lens 33, inside the storage space S. Further, for example, the light L2 is incident on the light-guide lens 33 through the end face 33A, is guided by the light-guide lens 33, and is emitted through the end face 33B. The light detector 62, which is described later, detects the light L2. A light detecting result (input amount) by the light detector 62 changes depending on the quantity of toner remaining in the toner storage 30. In the image formation apparatus 1, the quantity of toner remaining in the toner storage 30 is detected based on the light detecting result by the light detector 62.

The shaft 34 serves as a member that is configured to be rotatable about a rotation axis A. For example, as illustrated in FIGS. 2 to 4, the wiping member 35 and a wing-shaped stirring member (not illustrated) are attached to the shaft 34. The shaft 34 rotates in a rotation direction R by a power transmitted from the drum motor, which is not illustrated.

As illustrated in FIG. 5, one end of the shaft 34 is supported by a bearing hole 101A of a bearing part 101, and the other end of the shaft 34 is supported by a bearing hole 102A of a bearing part 102. A length LL1 between a bottom portion of the bearing hole 101A and a bottom portion of the bearing hole 102A is set longer than a length LL2 of the shaft 34. Specifically, in this example, a gap is formed between the bottom portion of the bearing hole 101A and one end of the shaft 34, and another gap is formed between the bottom portion of the bearing hole 102A and the other end of the shaft 34. This enables the shaft 34 to move in the axis direction of the shaft 34 by a difference between the length LL1 and the length LL2.

The wiping member 35 serves as a member that cleans the end face 32B of the light-guide lens 32 and the end face 33A of the light-guide lens 33. The wiping member 35 is fixed to the shaft 34 at a position corresponding to the gap S1 between the light-guide lenses 32 and 33 in the axis direction of the shaft 34, as illustrated in FIGS. 3 and 4. The wiping member 35 is configured by using an elastic material, for example. The wiping member 35 comes into contact with the end face 32B of the light-guide lens 32 and the end face 33A of the light-guide lens 33 with the rotation of the shaft 34 about the rotation axis A, thereby wiping and removing adhering matters (deposits) on the surfaces of the end face 32B and 33A.

A width W of the wiping member 35 is set wider than that of the lens interval SP, for example, as illustrated in FIG. 6. In other words, in the image formation apparatus 1, an overlap amount WOL (=(W−SP)/2) that is an amount depending on a difference between the width W of the wiping member 35 and the lens interval SP is set to be positive.

The wiping member 35 includes a slit 35A. The slit 35A is formed nearby the center of the wiping member 35 in the axis direction of the shaft 34 so as to extend in a direction intersecting the axis direction of the shaft 34, as illustrated in FIGS. 4 and 6. A width (slit width WS) of the slit 35A is set to be equal to or less than approximate 1/10 of the width W of the wiping member 35, for example. This deforms the wiping member 35 in a direction toward which the width WS of the slit 35A becomes narrow. Accordingly, the wiping member 35 is likely to absorb a pressing force to be received from the side surfaces to the center when the wiping member 35 wipes the end face 32B of the light-guide lens 32 and the end face 33A of the light-guide lens 33. In other words, providing the slit 35A can make the wiping member 35 easy to deform.

The wiping member 35 can be configured by using a polytetrafluoroethylene (PTFE) film, for example. The elastic modulus (Young's modulus) of the PTFE film is 420 MPa, for example. When the PTFE film is used, the width W of the wiping member 35 can be set to 7 mm, for example, and the thickness of the wiping member 35 can be set to 0.08 mm, for example. It should be noted that the material of the wiping member 35 is not limited to the PTFE film, but as an alternative to the PTFE film, for example, a polyethylene terephthalate (PET) film, a polystyrene film, a polypropylene film, or a polyimide film can be used. The elastic modulus (Young's modulus) of the polyimide film is 3.3 GPa, for example. When the polyimide film is used, the width W of the wiping member 35 can be set to 7 mm, for example, and the thickness of the wiping member 35 can be set to 0.125 mm, for example. The material and the elastic modulus of the wiping member 35 can be arbitrarily set for implementing necessary wiping.

The guide member 36 serves as a member that guides the wiping member 35 to the gap S1 between the light-guide lenses 32 and 33. The guide member 36 is provided upstream of the light-guide part 31 (light-guide lenses 32 and 33) in the rotation direction R. The guide member 36 has oblique surfaces, and the oblique surfaces varies the guide width of the guide member 36 to be narrow toward the gap S1. Specifically, when the guide width of the guide member 36 on an upstream end in the rotation direction R is set as W1, and the guide width of the guide member 36 on a downstream end in the rotation direction R is set as W2, the guide widths W1 and W2 are set to satisfy the following expression (1), for example.

$$W2 \leq SP < W < W1 \quad (1)$$

Specifically, for example, as illustrated in FIG. 6, the guide width W1 of the guide member 36 on the upstream end in the rotation direction R is set to a width larger than the width W of the wiping member 35. For example, the width W of the wiping member 35 is set to a width larger than the lens interval SP. Moreover, for example, the guide width W2 of the guide member 36 on the downstream end in the rotation direction R is set to be equal to or less than the lens interval SP. The guide width W1 can be set to 9 mm, for example, the width W of the wiping member 35 can be set to 7 mm, for example, the lens interval SP can be set to 6 mm, for example, and the guide width W2 can be set to 6 mm, for example.

The stirring bar 37 (FIG. 2) serves as a member that stirs toner stored in the toner storage 30. The stirring bar 37 is provided around the supply roller 28 in the storage space S of the toner storage 30. The stirring bar 37 rotates by a power transmitted from the drum motor, which is not illustrated.

The four exposure heads 15 (FIG. 1) are members that respectively irradiate the photoconductive drums 21 of the corresponding image formation units 13 with light. Specifically, the exposure head 15C irradiates the photoconductive drum 21 of the image formation unit 13C with light, the exposure head 15M irradiates the photoconductive drum 21 of the image formation unit 13M with light, the exposure head 15Y irradiates the photoconductive drum 21 of the image formation unit 13Y with light, and the exposure head 15K irradiates the photoconductive drum 21 of the image formation unit 13K with light. The exposure head 15 includes, for example, multiple light-emitting diodes that are arranged in parallel in a main scanning direction (depth direction in FIG. 1), and irradiates the photoconductive drum 21 with light in units of dots, using these light-emitting diodes. This causes these photoconductive drums 21 to be exposed to light by the corresponding exposure heads 15, and electrostatic latent images to be respectively formed on the surfaces of the photoconductive drums 21.

The transfer section 40 transfers the toner images formed by the four image formation units 13 onto a transfer-receiving surface of the recording medium 9. The transfer section 40 includes a transfer belt 41, four transfer rollers 42 (transfer rollers 42C, 42M, 42Y, and 42K), a driving roller 43, and a driven roller 44.

The transfer belt 41 conveys the recording medium 9 along the conveyance path 10 toward the conveyance direction F. The transfer belt 41 is tensioned by (stretched around) the driving roller 43 and the driven roller 44. Further, the transfer belt 41 is circulatedly conveyed along with the rotation of the driving roller 43 in the direction of the conveyance direction F.

The transfer roller 42C is placed opposite the photoconductive drum 21 of the image formation unit 13C via the conveyance path 10 and the transfer belt 41, the transfer roller 42M is placed opposite the photoconductive drum 21 of the image formation unit 13M via the conveyance path 10 and the transfer belt 41, the transfer roller 42Y is placed opposite the photoconductive drum 21 of the image formation unit 13Y via the conveyance path 10 and the transfer belt 41, and the transfer roller 42K is placed opposite the photoconductive drum 21 of the image formation unit 13K via the conveyance path 10 and the transfer belt 41. The voltage controller 57, which is described later, applies a transfer voltage to each of the transfer rollers 42C, 42M, 42Y, and 42K. This transfers toner images formed by the respective image formation units 13 onto the recording surface of the recording medium 9, in the image formation apparatus 1.

The driving roller 43 serves as a member that circulatedly conveys the transfer belt 41. In this example, the driving roller 43 is placed downstream of the four image formation units 13 in the conveyance direction F. The driving roller 43 rotates in a counter-clockwise direction in this example by a power transmitted from a belt motor (not illustrated).

The driven roller 44 serves as a member that is driven to rotate along with the circulation conveyance of the transfer belt 41. In this example, the driven roller 44 is placed upstream of the four image formation units 13 in the conveyance direction F.

The fixation section 16 serves as a member that applies heat and pressure on the recording medium 9 to fix the transferred toner images on the recording surface, to the recording medium 9. The fixation section 16 includes a heat roller 16A and a pressure roller 16B. The heat roller 16A serves as a member that applies heat to toner on the recording medium 9. The heat roller 16A includes, for example, a halogen heater or a ceramic heater. The pressure roller 16B serves as a member that is placed to form a pressure contact part with the heat roller 16A, and applies a pressure to toner on the recording medium 9. This heats, fuses, and pressurizes the toner on the recording medium 9 in the fixation section 16. As a result, the toner images are fixed onto the recording medium 9.

The conveyance roller pair 17 serves as a member that includes a pair of rollers between which the conveyance path 10 is sandwiched, and is a member that conveys the recording medium 9 supplied from the fixation section 16 along the conveyance path 10. The discharge roller pair 18 serves as a member that includes a pair of rollers between which the conveyance path 10 is sandwiched, and is a member that conveys the recording medium 9 supplied from the conveyance roller pair 17 along the conveyance path 10, and discharges the recording medium 9 to the outside of the image formation apparatus 1.

With this configuration, the image formation apparatus 1 forms an image on the recording medium 9. Further, the recording medium 9 on which the image is formed is stacked on a stacker 19.

Figure 7:
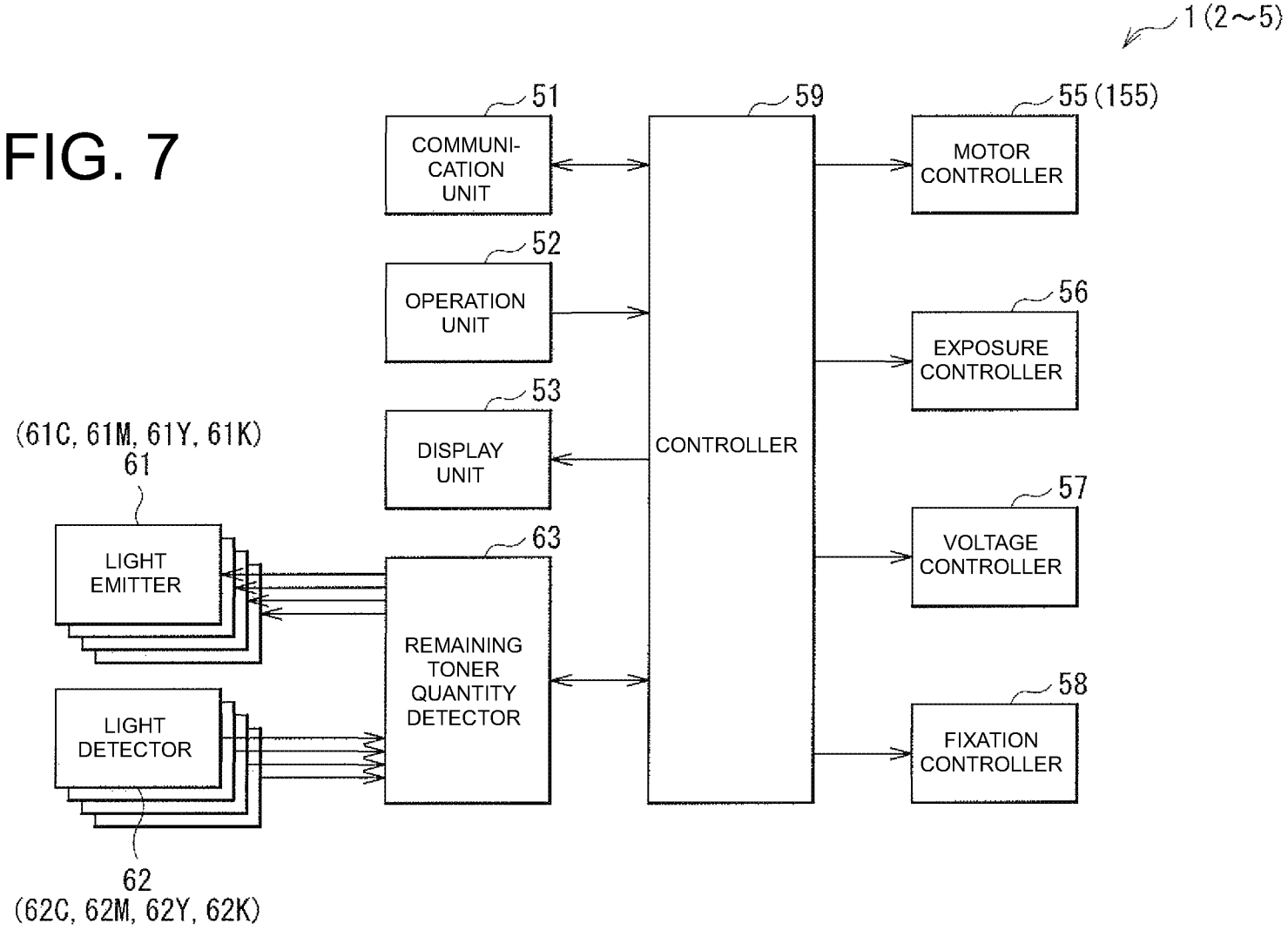
FIG. 7 is a block diagram illustrating one example of a control mechanism in the image formation apparatus illustrated in FIG. 1.

FIG. 7 illustrates one example of a control mechanism in the image formation apparatus 1. The image formation apparatus 1 is provided with a communication unit 51, an operation unit 52, a display unit 53, four light emitters 61 (light emitters 61C, 61M, 61Y, and 61K), four light detectors 62 (light detectors 62C, 62M, 62Y, and 62K), a remaining toner quantity detector 63, a motor controller 55, an exposure controller 56, the voltage controller 57, a fixation controller 58, and a controller 59.

The communication unit 51 performs communication using, for example, a universal serial bus (USB) or a local area network (LAN), and receives, for example, printing data DP transmitted from a host computer (not illustrated). The operation unit 52 accepts an operation by a user, and is configured by using a touch panel or various kinds of buttons, for example. The display unit 53 displays an operation state and the like of the image formation apparatus 1, and is configured by using a liquid crystal display or various kinds of indicators, for example.

Each of the four light emitters 61 emits the light L1 to be incident on the end face 32A of the light-guide lens 32 in the corresponding image formation unit 13, based on an instruction from the remaining toner quantity detector 63. Specifically, the light emitter 61C emits the light L1 to be incident on the end face 32A of the light-guide lens 32 in the image formation unit 13C, the light emitter 61M emits the light L1 to be incident on the end face 32A of the light-guide lens 32 in the image formation unit 13M, the light emitter 61Y emits the light L1 to be incident on the end face 32A of the light-guide lens 32 in the image formation unit 13Y, and the light emitter 61K emits the light L1 to be incident on the end face 32A of the light-guide lens 32 in the image formation unit 13K. Each of the light emitters 61 can be configured by using a light-emitting diode that emits infrared rays, for example.

Each of the four light detectors 62 receives and accepts the light L2 emitted from the end face 33B of the light-guide lens 33 in the corresponding image formation unit 13. Specifically, the light detector 62C detects the light L2 emitted from the end face 33B of the light-guide lens 33 in the image formation unit 13C, the light detector 62M detects the light L2 emitted from the end face 33B of the light-guide lens 33 in the image formation unit 13M, the light detector 62Y detects the light L2 emitted from the end face 33B of the light-guide lens 33 in the image formation unit 13Y, and the light detector 62K detects the light L2 emitted from the end face 33B of the light-guide lens 33 in the image formation unit 13K. Each of the light detectors 62 can be configured by using a photo transistor, for example.

The remaining toner quantity detector 63 detects the respective quantities of toner remaining in the toner storages 30 of the four image formation units 13. Specifically, the remaining toner quantity detector 63 controls, for example, when the four image formation units 13 perform the image formation operations, operations of the four light emitters 61 such that the four light emitters 61 respectively emit the light L1. Further, the remaining toner quantity detector 63 detects, based on light detecting results in the four light detectors 62, the respective quantities of toner remaining in the toner storages 30 of the four image formation units 13.

The motor controller 55 controls, based on the instruction from the controller 59, operations of various kinds of motors such as the drum motor and the belt motor in the image formation apparatus 1. The exposure controller 56 controls, based on the instruction from the controller 59, exposure operations in the four exposure heads 15. The voltage controller 57 generates, based on the instruction from the controller 59, various kinds of voltages such as the charge voltage, the development voltage, the supply voltage, and the transfer voltage, which are used in the four image formation units 13 and the transfer section 40. The fixation controller 58 controls, based on the instruction from the controller 59, a fixation operation in the fixation section 16.

The controller 59 controls the operations of all the blocks in the image formation apparatus 1, thereby controlling an overall operation of the image formation apparatus 1. The controller 59 is configured by using a processor that can execute a program, for example.

Here, the image formation unit 13 corresponds to one specific example of the "developer container" and the "image formation unit" in the disclosure. The toner storage 30 corresponds to one specific example of the "container" in the disclosure. The light-guide part 31 corresponds to one specific example of the "optical system" in the disclosure. The light-guide lens 32 corresponds to one specific example of the "first optical member" in the disclosure. The end face 32B corresponds to one specific example of the "first end face" in the disclosure. The light-guide lens 33 corresponds to one specific example of the "second optical member" in the disclosure. The end face 33A corresponds to one specific example of the "second end face" in the disclosure. The shaft 34 corresponds to one specific example of the "shaft" in the disclosure. The wiping member 35 corresponds to one specific example of the "cleaning member" in the disclosure. The guide member 36 corresponds to one specific example of the "guide member" in the disclosure. The bearing part 101 corresponds to one specific example of the "first bearing part" in the disclosure. The bearing hole 101A corresponds to one specific example of the "first bearing hole" in the disclosure. The bearing part 102 corresponds to one specific example of the "second bearing part" in the disclosure. The bearing hole 102A corresponds to one specific example of the "second bearing hole" in the disclosure. The light emitter 61 corresponds to one specific example of the "light emitter" in the disclosure. The light detector 62 corresponds to one specific example of the "light detector" in the disclosure. The remaining toner quantity detector 63 corresponds to one specific example of the "developer detector" in the disclosure.

[Operation and Effect]

Subsequently, an operation and an effect of the image formation apparatus 1 in the present embodiment are explained.

(Overall Operation Overview)

Firstly, with reference to FIGS. 1, 2, and 7, the overall operation overview of the image formation apparatus 1 is explained. When the communication unit 51 (FIG. 7) receives the printing data DP from the host computer, the controller 59 controls all the blocks such that the image formation apparatus 1 performs an image formation operation. The medium feed roller 11 and the registration roller pair 12 (FIG. 1) convey the recording medium 9 along the conveyance path 10 to the image formation units 13.

In each of the four image formation units 13, the stirring bar 37 (FIG. 2) stirs toner stored in the toner storage 30. Moreover, along with the rotation of the shaft 34, the wiping member 35 cleans the end face 32B of the light-guide lens 32 and the end face 33A of the light-guide lens 33. The photoconductive drum 21 is electrically charged by the charge roller 24, and is exposed to light in units of dots by the exposure head 15. This forms an electrostatic latent image on the photoconductive drum 21. Further, the development roller 26 supplies toner to the photoconductive drum 21. This forms a toner image in accordance with the electrostatic latent image on the photoconductive drum 21.

The transfer section 40 (FIG. 1) transfers the toner images formed by the four image formation units 13 onto the transfer-receiving surface of the recording medium 9. The fixation section 16 fixes the toner images transferred on the recording medium 9, to the recording medium 9. The conveyance roller pair 17 and the discharge roller pair 18 convey the recording medium 9 along the conveyance path 10, and discharges the recording medium 9 to the outside of the image formation apparatus 1.

(Detailed Operation)

In the image formation apparatus 1, while the four image formation units 13 perform the image formation operations, each of the four light emitters 61 emits the light L1 to be incident on the end face 32A of the light-guide lens 32 in the corresponding image formation unit 13, based on an instruction from the remaining toner quantity detector 63. In the image formation unit 13, the light L1 is incident on the light-guide lens 32 through the end face 32A, is guided by the light-guide lens 32, and is emitted through the end face 32B. For example, part of the light L1 is blocked by toner in a clearance (gap S1) between the end face 32B of the light-guide lens 32 and the end face 33A of the light-guide lens 33, inside the storage space S. Further, for example, the light L2 is incident on the light-guide lens 33 through the end face 33A, is guided by the light-guide lens 33, and is emitted through the end face 33B. Each of the four light detectors 62 detects the light L2 emitted from the end face 33B of the light-guide lens 33 in the corresponding image formation unit 13. Further, the remaining toner quantity detector 63 detects, based on light detecting results in the four light detectors 62, the respective quantities of toner remaining in the toner storages 30 of the four image formation units 13.

Figure 8:
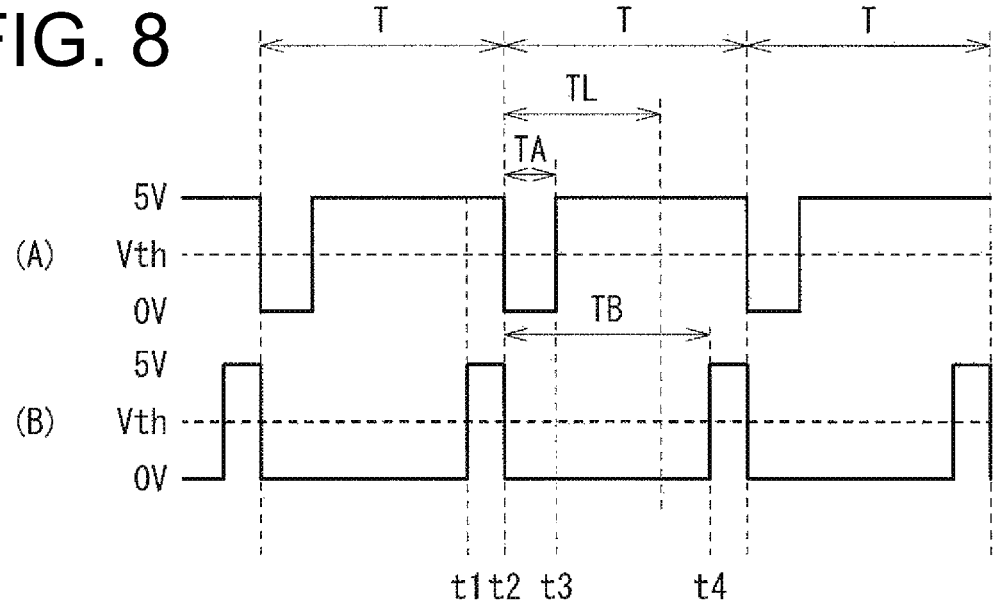
FIG. 8 illustrates timing waveform charts (A) and (B) each illustrating one operation example of a remaining toner quantity detector illustrated in FIG. 7.
Figure 9A:
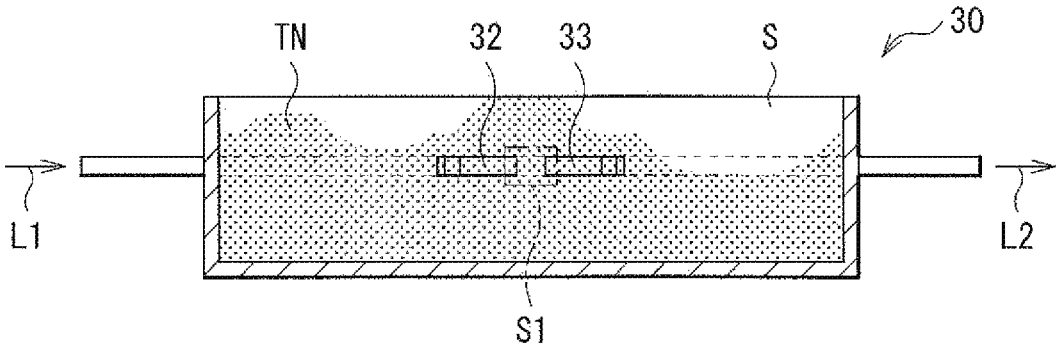
FIG. 9A is an explanation diagram illustrating one state in the toner storage section illustrated in FIG. 2.
Figure 9B:
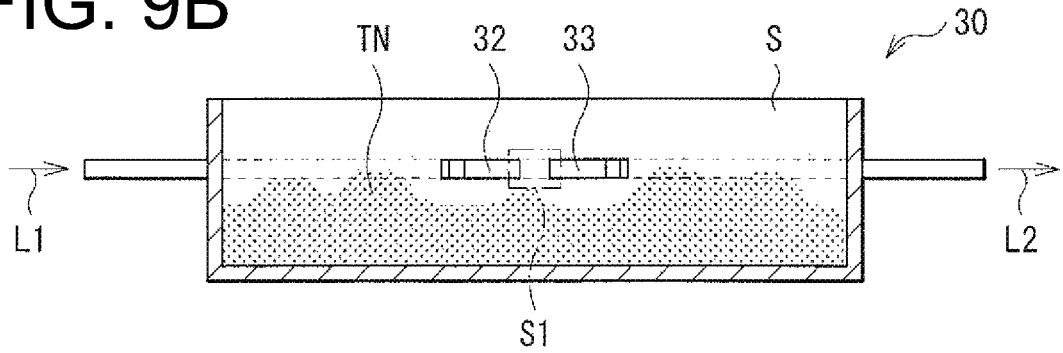
FIG. 9B is an explanation diagram illustrating another state in the toner storage section illustrated in FIG. 2.

FIG. 8 illustrates timing waveform charts (A) and (B) each illustrates one example of a light detecting signal DET outputted from the light detector 62. Specifically, FIG. 8(A) illustrates a case where much toner is stored in the toner storage 30, whereas FIG. 8(B) illustrates a case where a little toner is stored in the toner storage 30. FIG. 9A schematically illustrates a state where much toner is stored in the toner storage 30, and FIG. 9B schematically illustrates a state where a little toner is stored in the toner storage 30. In FIGS.

8(A) and 8(B), the voltage of the light detecting signal DET becomes 0 V when the amount of received light in the light detector 62 is the maximum, and becomes 5 V when the amount of received light in the light detector 62 is almost zero. A threshold voltage Vth is set to 2.5 V, for example. Moreover, time T is time corresponding to a rotation cycle of the shaft 34.

In a period of timing from t1 to t2, the wiping member 35 cleans the end face 32B of the light-guide lens 32 and the end face 33A of the light-guide lens 33 along with the rotation of the shaft 34. At this time, the wiping member 35 blocks the light L1 emitted from the light-guide lens 32 through the end face 32B. Therefore, the almost no amount of the light L2 is incident on the light-guide lens 33 through the end face 33A, so that the amount of received light in the light detector 62 becomes low, and the voltage of the light detector signal DET becomes 5 V.

Further, at the timing t2, when the wiping member 35 has passed through the gap S1, the light L1 emitted from the end face 32B of the light-guide lens 32 is incident on the light-guide lens 33 through the end face 33A of the light-guide lens 33. In other words, for example, when much toner is stored in the toner storage section 30 (FIG. 9A), at the timing from t1 to t2, the wiping member 35 removes toner TN in the clearance (gap S1) between the end face 32B of the light-guide lens 32 and the end face 33A of the light-guide lens 33. Moreover, for example, when toner is stored in the toner storage section 30 (FIG. 9B), at the timing from t1 to t2, the wiping member 35 removes the toner TN having been adhered on the end face 32B of the light-guide lens 32 and the end face 33A of the light-guide lens 33. This causes the light L1 emitted from the end face 32B of the light-guide lens 32 at the timing t2 to be incident on the light-guide lens 33 through the end face 33A of the light-guide lens 33. As a result, the amount of received light in the light detector 62 becomes high, so that the voltage of the light detecting signal DET changes from 5 V to 0 V.

When much toner is stored in the toner storage section 30, as illustrated in FIG. 9A, the toner TN can intrude also into the clearance (gap S1) between the end face 32B of the light-guide lens 32 and the end face 33A of the light-guide lens 33. Accordingly, as illustrated in FIG. 8(A), at timing t3, the toner TN intrudes into the gap S1, and the toner TN blocks the light L1 emitted from the light-guide lens 32 through the end face 32B. Therefore, the almost no amount of the light L2 is incident on the light-guide lens 33 through the end face 33A, so that the amount of received light in the light detector 62 becomes low, and the voltage of the light detecting signal DET becomes 5 V. In other words, in this example, during the time from the timing t2 to the timing t3 (time length TA), the voltage of the light detecting signal DET is maintained to 0 V.

In contrast, when a little toner is stored in the toner storage section 30, as illustrated in FIG. 9B, no toner TN is present in the clearance (gap S1) between the end face 32B of the light-guide lens 32 and the end face 33A of the light-guide lens 33. Therefore, as illustrated in FIG. 8(B), in a period from the timing t2 to timing t4 when the wiping member 35 reaches the gap S1 next time, the light L1 is continuously incident on the light-guide lens 33 through the end face 33A of the light-guide lens 33, so that the amount of received light in the light detector 62 is kept high. In other words, in this example, during the time from the timing t2 to the timing t4 (time length TB), the voltage of the light detecting signal DET is maintained to 0 V.

The remaining toner quantity detector 63 detects a length of the time (time length TDET) during when the voltage of the light detecting signal DET is maintained to 0 V, and compares the time length TDET with a predetermined time length TL. The time length TL is set to a length that is longer than the time length TA (FIG. 8(A)) when much toner is stored in the toner storage section 30 and is shorter than the time length TB (FIG. 8(B)) when a little toner is stored in the toner storage section 30. Further, for example, the remaining toner quantity detector 63 determines that much toner is stored in the toner storage section 30 when the time length TDET shorter than the time length TL is detected continuously 10 times, for example. Moreover, for example, the remaining toner quantity detector 63 determines that a little toner is stored in the toner storage section 30 when the time length TDET longer than the time length TL is detected continuously 10 times, for example. Further, the remaining toner quantity detector 63 supplies the detection result to the controller 59.

When a little toner is stored in the toner storage section 30, the controller 59 instructs the toner storage section 30 and the toner container 14 corresponding to the toner storage section 30 to supply toner from the toner container 14 to the toner storage section 30. Accordingly, the toner container 14 and the toner storage section 30 cause, for example, a conveyance spiral, which is not illustrated, to operate, thereby supplying toner from the toner container 14 to the toner storage section 30. Further, in the toner storage section 30, the stirring bar 37 stirs toner.

When toner is continuously supplied to the toner storage section 30 to increase the quantity of toner in the toner storage section 30, for example, a waveform of the light detecting signal DET as illustrated in FIG. 8(A) is obtained. The remaining toner quantity detector 63 determines that much toner is stored in the toner storage section 30, based on the light detecting signal DET. The remaining toner quantity detector 63 supplies the detection result to the controller 59. Further, the controller 59 instructs the toner storage section 30 and the toner container 14 corresponding to the toner storage section 30 to stop the supply of toner from the toner container 14 to the toner storage section 30.

As described in the foregoing, in the period of the timing from t1 to t2, the wiping member 35 wipes, the end face 32B of the light-guide lens 32 and the end face 33A of the light-guide lens 33 along with the rotation of the shaft 34. In the process, sufficiently removing toner adhered on the end face 32B of the light-guide lens 32 and the end face 33A of the light-guide lens 33 is desired. This enables the light L1 emitted from the end face 32B of the light-guide lens 32 to be sufficiently incident on the light-guide lens 33 through the end face 33A of the light-guide lens 33. As a result, in the image formation apparatus 1, it is possible to enhance the detection accuracy in detection of the quantity of toner remaining in the toner storage section 30.

In the image formation apparatus 1, the width W of the wiping member 35 wider than the lens interval SP can increase the contact pressure of the wiping member 35 to the end face 32B of the light-guide lens 32 and the end face 33A of the light-guide lens 33. Consequently, it is possible to sufficiently wipe the end faces 32B and 33A. As a result, in the image formation apparatus 1, it is possible to enhance the detection accuracy in detection of the quantity of remaining toner.

Moreover, in the image formation apparatus 1, the shaft 34 can move in the axis direction of the shaft 34, and the guide member 36 that guides the wiping member 35 to the gap S1 between the light-guide lenses 32 and 33 is provided. The guide width of the guide member 36 is set to become narrower as being approached to the gap S1 as illustrated in FIG. 6, and such that the guide widths W1 and W2 satisfy the expression (1). This brings the wiping member 35 into contact with oblique surfaces of the guide member 36 to generate a reaction force in the wiping member 35, and the shaft 34 moves in the axis direction such that the wiping member 35 is guided to the gap S1. This makes it possible to sufficiently wipe the end faces 32B and 33A in the image formation apparatus 1, so that it is possible to enhance the detection accuracy in detection of the quantity of remaining toner.

In other words, for example, in a case where the shaft 34 is unable to move in the axis direction, for example, when positions of the wiping member 35 and the gap S1 are sifted to each other in the axis direction due to a size error, there is a risk that either one of the end faces 32B and 33A may not be sufficiently wiped. Moreover, in this case, an increase in load in the wiping member 35 makes the wiping member 35 easily wear. Consequently, the longer accumulated operation time of the image formation unit 13 results in more insufficient wiping performance.

In contrast, in the image formation apparatus 1, the shaft 34 can move in the axis direction, and the guide member 36 that guides the wiping member 35 is provided. Accordingly, the shaft 34 moves in the axis direction to adjust the relative positions of the wiping member 35 and the gap S1, thereby making it possible to guide the wiping member 35 to the gap S1. As a result, it is possible to sufficiently wipe the end faces 32B and 33A in the image formation apparatus 1, so that it is possible to enhance the detection accuracy in detection of the quantity of remaining toner.

Moreover, in the image formation apparatus 1, in this manner, the shaft 34 can move in the axis direction, and the guide member 36 that guides the wiping member 35 is provided. Consequently, it is possible to reduce the size of the image formation apparatus 1.

In other words, for example, in a case where the shaft 34 is unable to move in the axis direction, as described the above, either one of the end faces 32B and 33A may not be sufficiently wiped. In order to prevent this, for example, it is possible to make the width W of the wiping member 35 be wider to obtain the large overlap amount WOL (FIG. 6). However, in this case, the image formation unit 13 becomes large, and as a result, there is a risk that the entire size of the image formation apparatus 1 may also become large.

In contrast, in the image formation apparatus 1, the shaft 34 can move in the axis direction and the guide member 36 that guides the wiping member 35 is provided. Accordingly, the shaft 34 moves in the axis direction to make it possible to guide the wiping member 35 to the gap S1. Therefore, it is possible to sufficiently wipe the end faces 32B and 33A without making the overlap amount WOL be large in this manner. As a result, in the image formation apparatus 1, the width W of the wiping member 35 can be reduced, so that the image formation unit 13 can be made smaller. As a result, it is possible to reduce the size of the image formation apparatus 1.

Moreover, the wiping member 35 can be guided to the gap S1 in this manner. Accordingly, it is possible to reduce the lens interval SP. This can suppress the light emission amount in the light emitter 61, so that it is possible to configure the light emitter using a light-emitting element with a small light emission amount. As a result, it is possible to suppress the manufacturing cost of the image formation apparatus 1.

As in the foregoing, in the present embodiment, the shaft can move in the axis direction, and the guide member that guides the wiping member to the gap space of the light-guide lenses is provided. Consequently, it is possible to enhance the detection accuracy in detection of the quantity of remaining toner. Moreover, it is also possible to reduce the size of the image formation apparatus, and suppress the manufacturing cost of the image formation apparatus.

Modification Example 1

In the above-mentioned embodiment, although the shaft 34, the wiping member 35, and the light-guide part 31 are provided in the toner storage section 30 of the image formation unit 13, thereby detecting the quantity of toner remaining in the toner storage section 30, the invention is not limited to this. Instead of this, for example, a shaft, a wiping member, and a light-guide part may be provided in the toner container 14, thereby detecting the quantity of toner remaining in the toner container 14. Moreover, the shaft 34, the wiping member 35, and the light-guide part 31 may be provided in the toner storage section 30, and a shaft, a wiping member, and a light-guide part may be provided in the toner container 14, thereby respectively detecting the quantities of toner remaining in the toner storage section 30 and in the toner container 14.

2. Second Embodiment

Next, an image formation apparatus 2 according to a second embodiment is explained. The present embodiment is different from the first embodiment in a mechanism in which the wiping member 35 is guided by the guide member 36. In other words, the first embodiment (FIG. 5) is configured such that the shaft 34 itself to which the wiping member 35 is fixed moves in the axis direction of the shaft 34. Instead of this configuration, the present embodiment is configured such that the wiping member 35 is fixed to a support plate, and the support plate moves relative to the shaft in the axis direction of a shaft. It should be noted that same reference numerals are given to elements substantially the same as those in the image formation apparatus 1 according to the first embodiment, and explanations thereof are omitted as appropriate.

As illustrated in FIG. 1, the image formation apparatus 2 is provided with four image formation units 73 (image formation units 73C, 73M, 73Y, and 73K). Each of the four image formation units 73 includes a toner storage section 80, as illustrated in FIG. 2. The toner storage section 80 includes a shaft 84. As similar to the case of the first embodiment, one end of the shaft 84 is supported by the bearing hole 101A of the bearing part 101, and the other end of the shaft 84 is supported by the bearing hole 102A of the bearing part 102. In the present embodiment, a gap between the bottom portion of the bearing hole 101A and one end of the shaft 84 is suppressed to the minimum, and a gap between the bottom portion of the bearing hole 102A and the other end of the shaft 84 is suppressed to the minimum.

Figure 10:
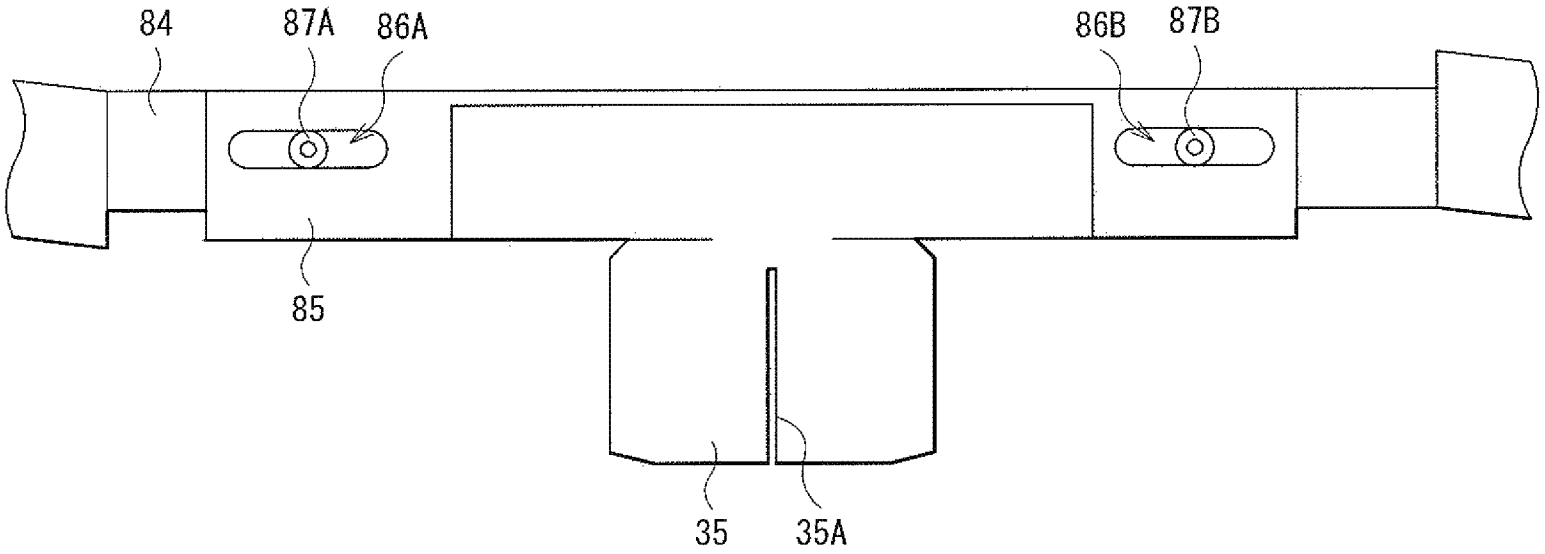
FIG. 10 is a configuration diagram illustrating one configuration example of a wiping member and a shaft according to a second embodiment.
Figure 11A:
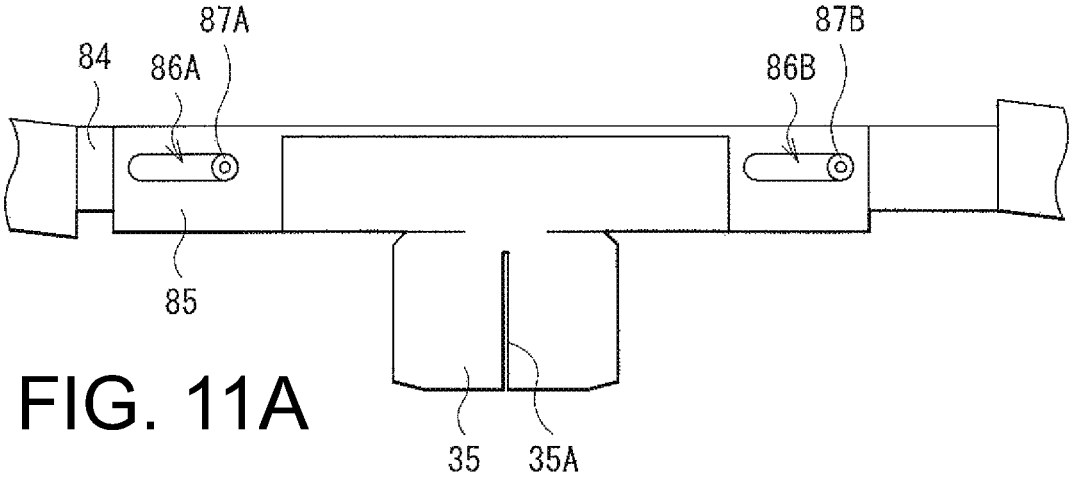
FIG. 11A is an explanation diagram illustrating one operation example of the shaft and a support plate illustrated in FIG. 10.
Figure 11B:
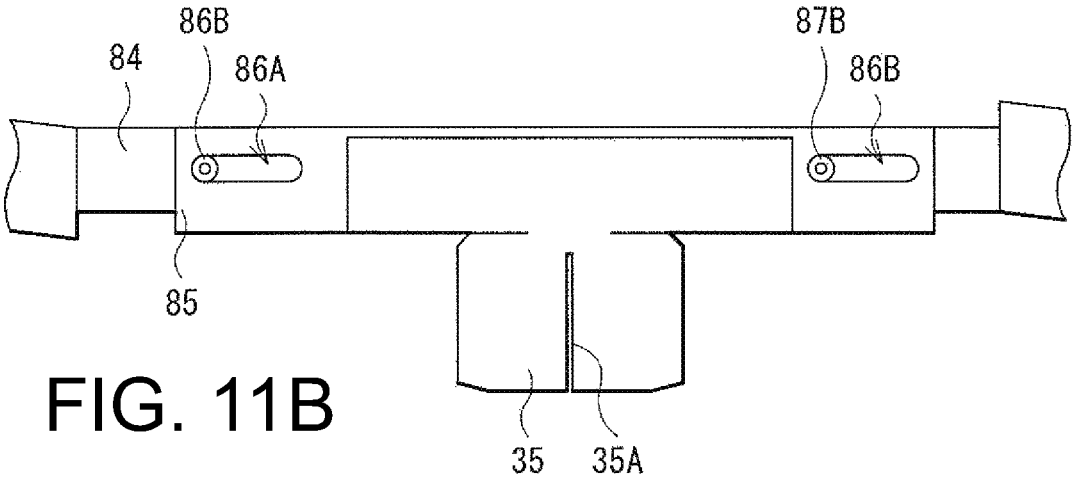
FIG. 11B is an explanation diagram illustrating another operation example of the shaft and the support plate illustrated in FIG. 10.

FIG. 10 illustrates one configuration example of the shaft 84 and the wiping member 35. FIGS. 11A and 11B each illustrate an operation example of the shaft 84. The toner storage section 80 includes a support plate 85.

The support plate 85 supports the wiping member 35. The wiping member 35 is fixed to the support plate 85. Moreover, the support plate 85 is provided to the shaft 84 so as to be movable in the axis direction of the shaft 84. In this example, the support plate 85 has two holes 86A and 86B. The two holes 86A and 86B are formed so as to be longer in the axis direction of the shaft 84. A pin 87A fixed to the shaft 84 penetrates through the hole 86A, and a pin 87B fixed to the shaft 84 penetrates through the hole 86B. This enables the support plate 85 to move in the axis direction of the shaft 84 by the length of the holes 86A and 86B, as illustrated in FIGS. 11A and 11B.

In this manner, the image formation apparatus 2 is configured such that the support plate 85 to which the wiping member 35 is fixed can move relative to the shaft 84 in the axis direction of the shaft 84. As similar to the case of the first embodiment, this makes the wiping member 35 come into contact with oblique surfaces of the guide member 36 to generate a reaction force in the wiping member 35, and the support plate 85 moves in the axis direction of the shaft 84 such that the wiping member 35 is guided to the gap S1. Accordingly, the relative positions of the wiping member 35 and the gap S1 are adjusted to make it possible to guide the wiping member 35 to the gap S1. As a result, it is possible to sufficiently wipe the end faces 32B and 33A in the image formation apparatus 2, so that it is possible to enhance the detection accuracy in detection of the quantity of remaining toner.

As in the foregoing, in the present embodiment, the support plate to which the wiping member is fixed can move relative to the shaft in the axis direction of the shaft. Consequently, it is possible to enhance the detection accuracy in detection of the quantity of remaining toner. The other effects are similar to those in the case of the first embodiment.

Modification Example 2-1

In the above-mentioned embodiments, although the support plate 85 is configured to be movable relative to the shaft 84 using the holes 86A and 86B and the pins 87A and 87B that are provided in the support plate 85, the invention is not limited to this. Alternatively, the support plate may be configured to be movable relative to the shaft, by other methods.

Modification Example 2-2

The modification example of the first embodiment may be applied to the image formation apparatus 2 according to the above-mentioned embodiment.

3. Third Embodiment

Next, an image formation apparatus 3 according to a third embodiment is explained. The present embodiment is different from the first embodiment in the configuration of the wiping member. It should be noted that same reference numerals are given to elements substantially the same as those in the image formation apparatus 1 according to the first embodiment, and explanations thereof are omitted as appropriate.

As illustrated in FIG. 1, the image formation apparatus 3 is provided with four image formation units 113 (image formation units 113C, 113M, 113Y, and 113K).

Figure 12:
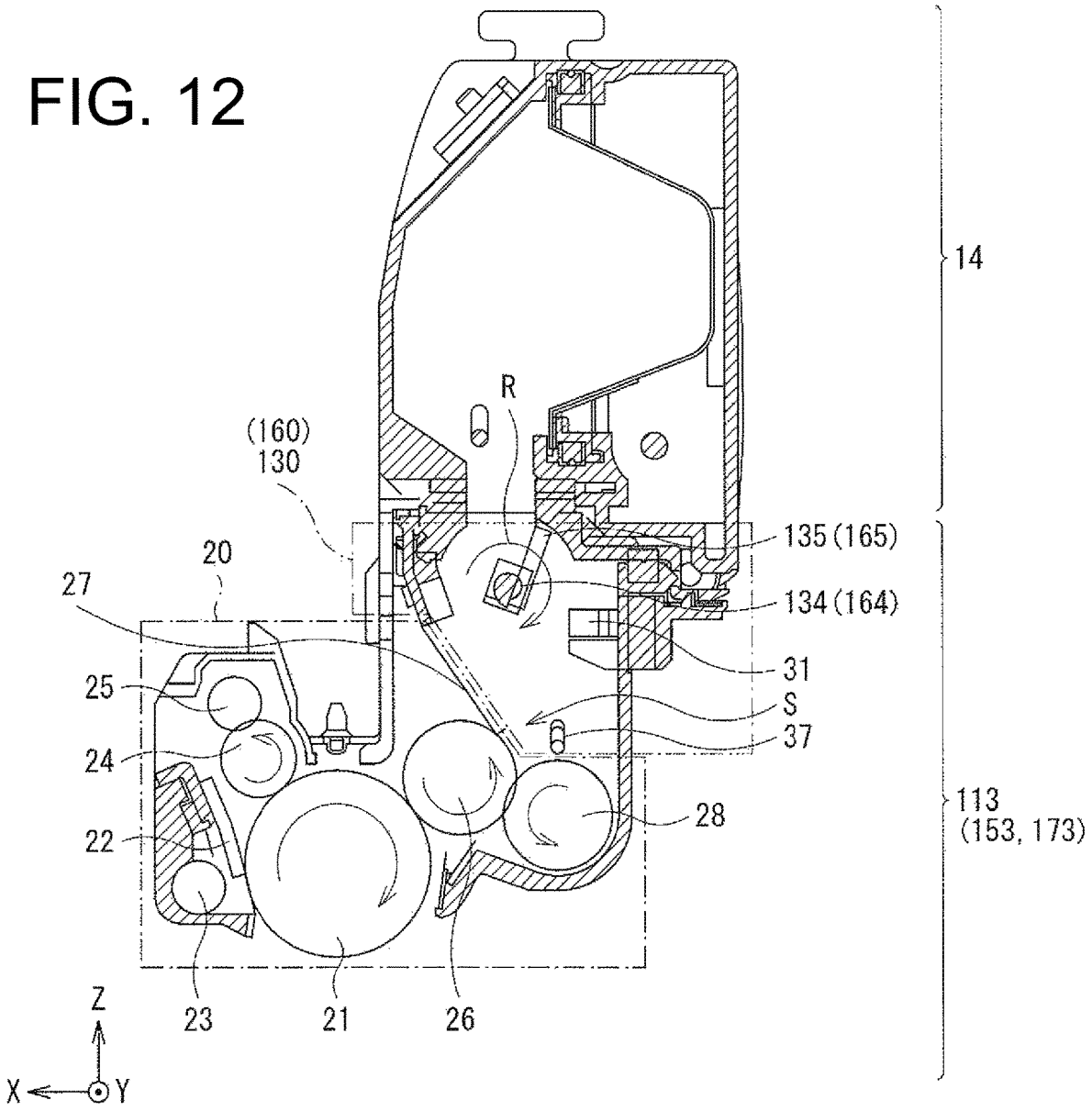
FIG. 12 is a configuration diagram illustrating one configuration example of an image formation unit according to a third embodiment.

FIG. 12 illustrates one configuration example of the image formation unit 113. It should be noted that FIG. 12 also illustrates the toner container 14. The image formation unit 113 includes a toner storage section 130. The toner storage section 130 includes a shaft 134 and a wiping member 135.

Figure 13:
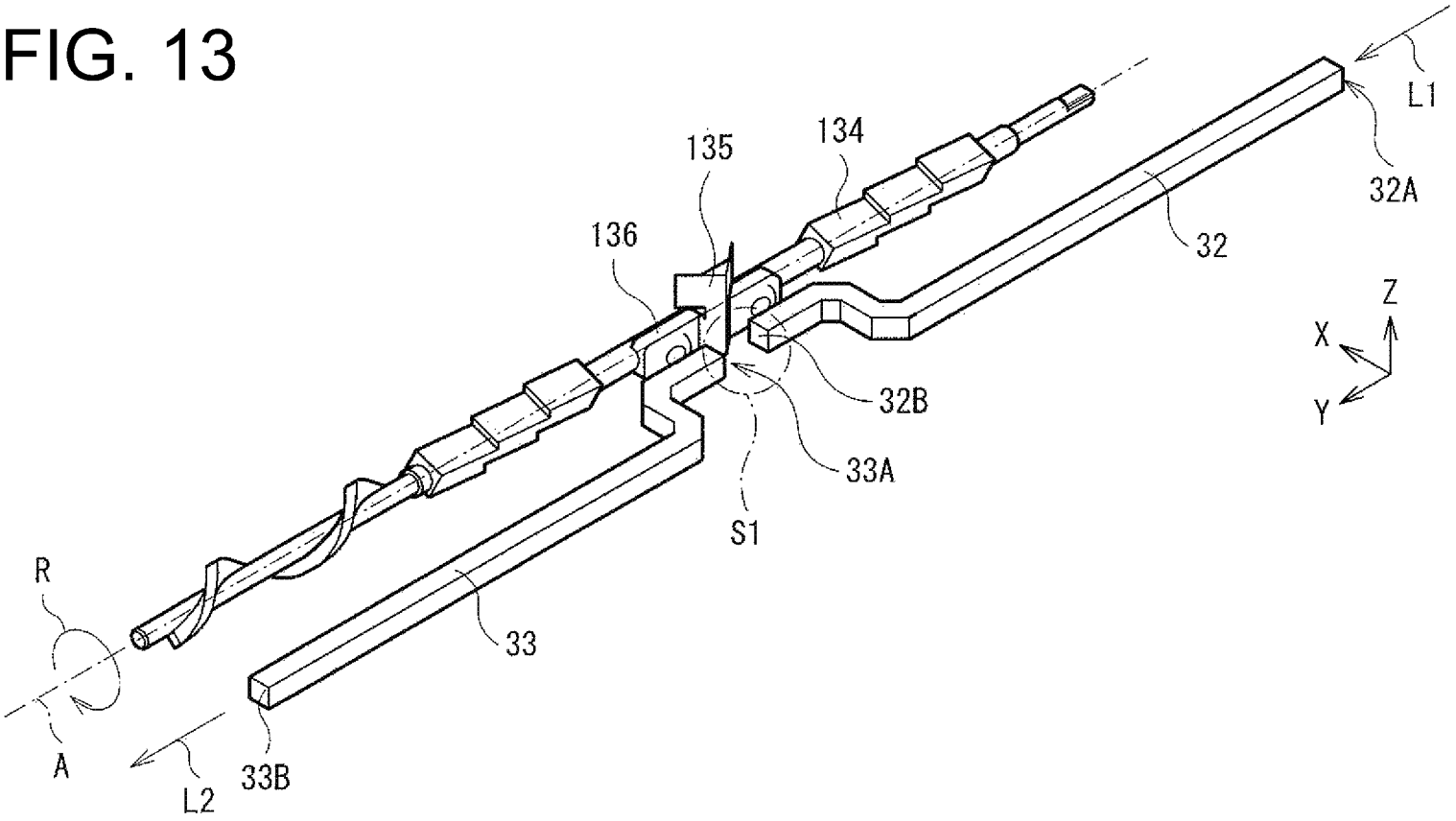
FIG. 13 is a perspective view illustrating one configuration example of a wiping member and a light-guide part according to a third embodiment.
Figure 14:
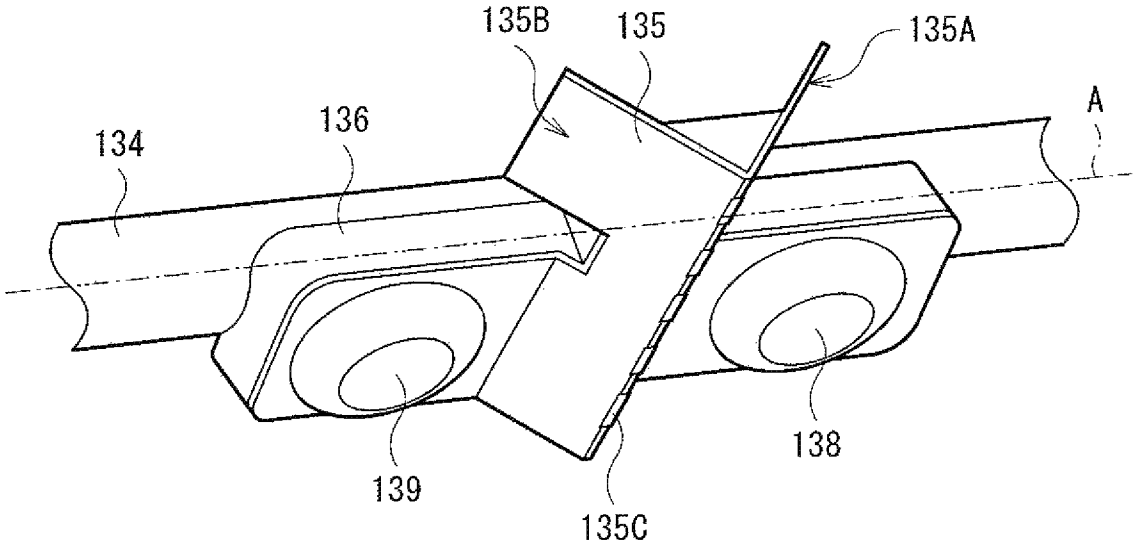
FIG. 14 is a perspective view illustrating one configuration example of the wiping member and a support member illustrated in FIG. 13.

FIG. 13 illustrates one or multiple configuration examples of the shaft 134, the wiping member 135, and the light-guide part 31. FIG. 14 illustrates one configuration example of the wiping member 135. The toner storage section 130 includes a support member 136, and fixing members 138 and 139.

The shaft 134 serves as a member that is configured to be rotatable about the rotation axis A. For example, as illustrated in FIGS. 13 and 14, the wiping member 135 is attached to the shaft 134. The shaft 134 can move in the axis direction of the shaft 134 similar to the shaft 34 (FIG. 5) according to the first embodiment.

The wiping member 135 serves as a member that cleans the end face 32B of the light-guide lens 32 and the end face 33A of the light-guide lens 33. The wiping member 135 is configured by using, for example, a PTFE film, a PET film, a polystyrene film, a polypropylene film, or a polyimide film, similar to the wiping member 35 according to the first embodiment. The thickness of the wiping member 135 can be set to, for example, equal to or more than 0.05 mm and equal to or less than 0.3 mm. When the polyimide film is used, the thickness of the wiping member 135 can be set to 0.125 mm, for example. The wiping member 135 is fixed to the shaft 134 at a position corresponding to the gap S1 between the light-guide lenses 32 and 33 in the axis direction of the shaft 134, as illustrated in FIG. 13. Specifically, as described later, the support member 136 is provided to the shaft 134 at a position corresponding to the gap S1 between the light-guide lenses 32 and 33 in the axis direction of the shaft 134. The wiping member 135 is bonded to the support member 136 using a double-sided adhesive tape for example, and fixed thereto by the fixing members 138 and 139. The wiping member 135 wipes the end face 32B of the light-guide lens 32 and the end face 33A of the light-guide lens 33 with the rotation of the shaft 134 about the rotation axis A.

The wiping member 135 includes two oblique surfaces 135A and 135B that are inclined with respect to the axis direction of the shaft 134 while extending in opposite directions like V-shape, as illustrated in FIG. 14. Further, a portion in the wiping member 135 corresponding to a ridge line between the oblique surface 135A and the oblique surface 135B is provided with a perforation 135C. The wiping member 135 is guided by the two oblique surfaces 135A and 135B to the gap S1 between the light-guide lenses 32 and 33. In other words, in the image formation apparatus 1 according to the first embodiment, the guide member 36 including the oblique surfaces is provided, and the wiping member 35 comes into contact with the oblique surfaces of the guide member 36, thereby guiding the wiping member 35 to the gap S1 between the light-guide lenses 32 and 33. In contrast, in the image formation apparatus 3 according to the present embodiment, the oblique surfaces 135A and 135B are provided in the wiping member 135, and the oblique surfaces 135A and 135B of the wiping member 135 come into contact with the light-guide lenses 32 and 33, thereby guiding the wiping member 135 to the gap S1 between the light-guide lenses 32 and 33.

The support member 136 serves as a member that supports the wiping member 135. The support member 136 is provided at a position corresponding to the gap S1 between the light-guide lenses 32 and 33 in the axis direction of the shaft 134, and is formed integrally with the shaft 134, in this example. The support member 136 includes, two oblique surfaces (oblique surfaces 136C and 136D, which are described later) that are inclined with respect to the axis direction of the shaft 134 while extending in opposite directions, as described later. Further, the two oblique surfaces 135A and 135B of the wiping member 135 are placed respectively along the two oblique surfaces of the support member 136. In this manner, the support member 136 supports the oblique surfaces 135A and 135B of the wiping member 135.

The fixing members 138 and 139 serve as members that fix the wiping member 135 to the support member 136. The fixing members 138 and 139 are deformed to crush by a heat caulking tool in the manufacturing process, thereby fixing the wiping member 135 to the support member 136.

Figure 15:
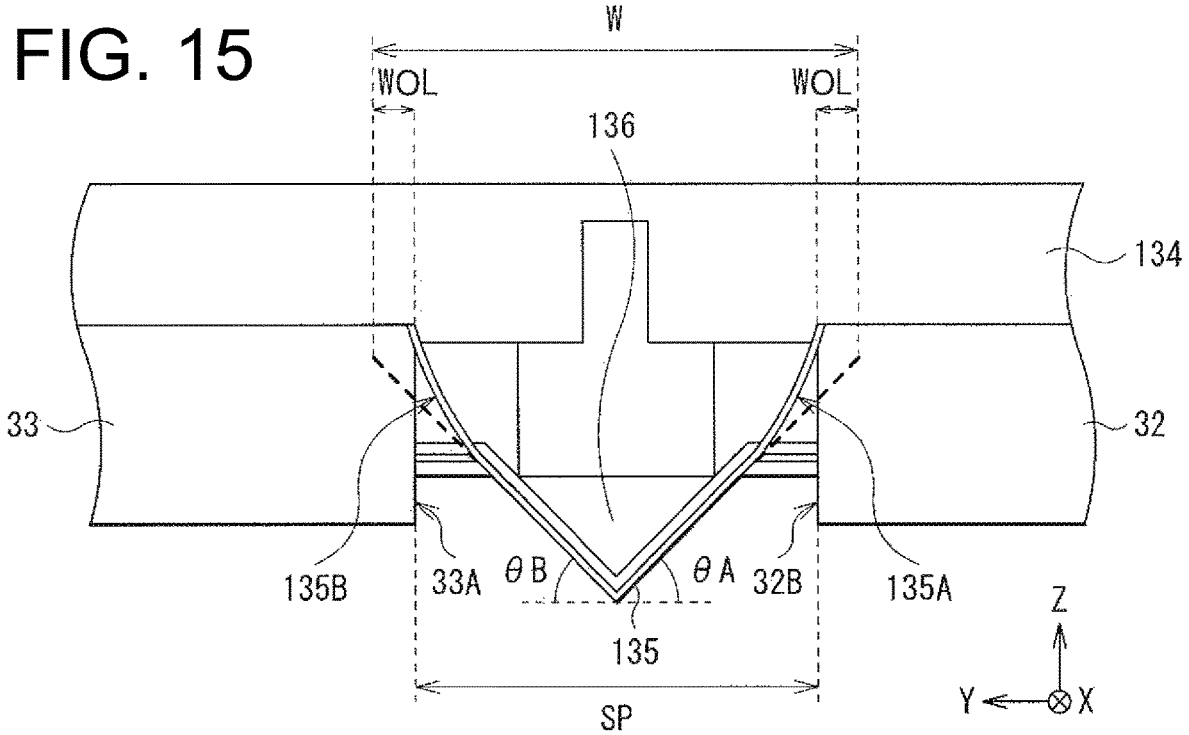
FIG. 15 is an explanation diagram illustrating one example of a positional relationship between the wiping member and the support member illustrated in FIG. 13.
Figure 16:
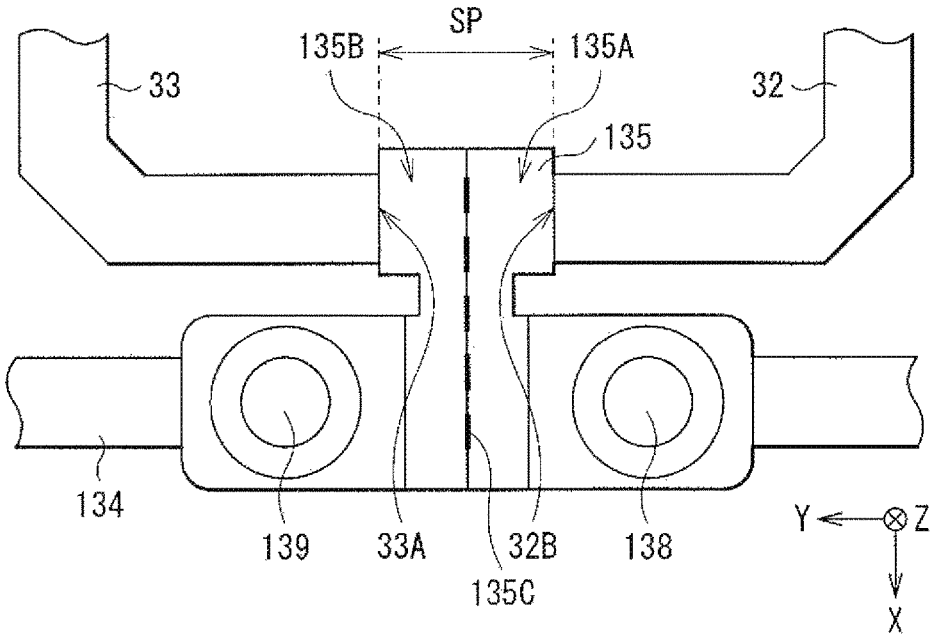
FIG. 16 is another explanation diagram illustrating one example of the positional relationship between the wiping member and the support member illustrated in FIG. 13.

FIGS. 15 and 16 illustrate one example of a positional relationship between the wiping member 135 and the light-guide part 31 when the wiping member 135 is guided to the gap S1 between the light-guide lenses 32 and 33. FIG. 15 illustrates the positional relationship between the wiping member 135 and the light-guide part 31 when seen from an X direction, and FIG. 16 illustrates the positional relationship between the wiping member 135 and the light-guide part 31 when seen from a Z direction. In FIG. 15, the wiping member 135 in an undistorted (an unwarped) state is illustrated by thick dashed lines.

With respect to the axis direction of the shaft 134, an inclination angle θA of the oblique surface 135A of the wiping member 135 with respect to is 45 degrees in this example, and an inclination angle θB of the oblique surface 135B of the wiping member 135 is 45 degrees in this example. As illustrated in FIG. 15, the width W of the wiping member 135 in an undistorted state is set to a width larger than the lens interval SP. The width W of the wiping member 135 can be set to, for example 8 mm, the lens interval SP can be set to, for example, 6 mm, and the overlap amount WOL can be set to, for example, 1 mm. In this manner, the width W of the wiping member 135 is set to the width larger than the lens interval SP to cause the wiping member 135 to be distorted (warped), thereby allowing the high contact pressure of the wiping member 135 to the end face 32B of the light-guide lens 32 and the end face 33A of the light-guide lens 33.

The inclination angles θA and θB may be set, for example, within a range of equal to or more than 10 degrees and equal to or less than 60 degrees. In other words, as the inclination angles θA and θB are closer to 0 degrees, the pressure in wiping becomes higher, and the inclination angles θA and θB are closer to 90 degrees, the wiping member 135 becomes larger, so that the wiping itself is more difficult to be performed. Accordingly, setting the inclination angles θA and θB, for example, within the range of equal to or more than 10 degrees and equal to or less than 60 degrees is desired.

Figure 17A:
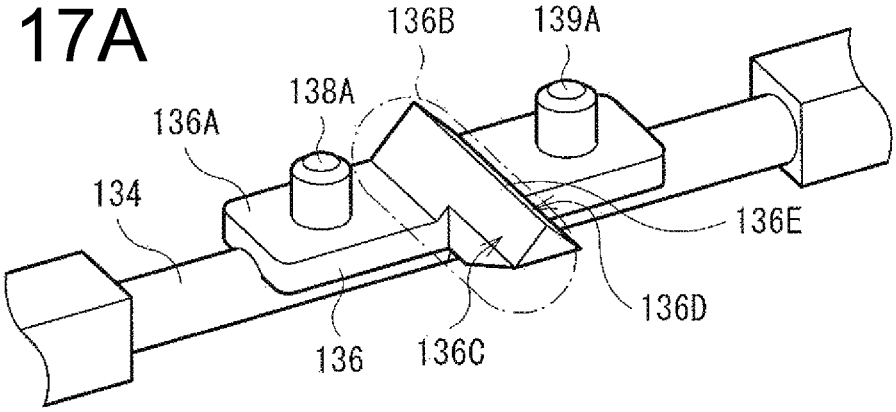
FIG. 17A is an explanation diagram illustrating one example of a process of fixing the wiping member to the support member.
Figure 17B:
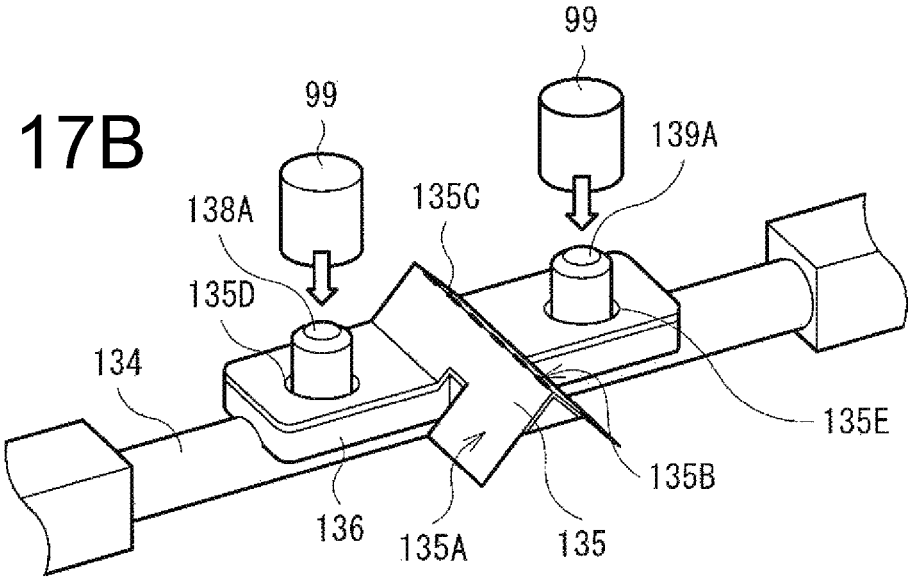
FIG. 17B is another explanation diagram illustrating one example of the process of fixing the wiping member to the support member.
Figure 17C:
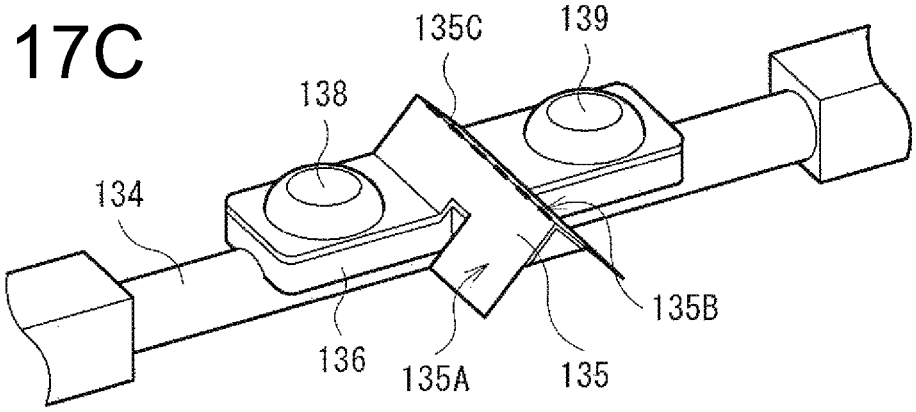
FIG. 17C is still another explanation diagram illustrating one example of the process of fixing the wiping member to the support member.

FIGS. 17A to 17C illustrates one example of a process of fixing the wiping member 135 to the support member 136. As illustrated in FIG. 17A, the support member 136 includes a pedestal part 136A and an inclination setting part 136B. Fixing members 138A and 139A are formed on the pedestal part 136A. The fixing members 138A and 139A each have a cylindrical shape, and become the fixing members 138 and 139 by being deformed to crush by the heat caulking tool. The inclination setting part 136B sets the inclination angles 8A and 8B of the oblique surfaces 135A and 135B of the wiping member 135, and is provided around the center of the pedestal part 136A in the axis direction of the shaft 134. The inclination setting part 136B includes the oblique surfaces 136C and 136D. The oblique surfaces 136C and 136D that are inclined with respect to the axis direction of the shaft 134 while extending in opposite directions, and a ridge line 136E is formed between the oblique surface 136C and the oblique surface 136D.

The wiping member 135 is placed on such the support member 136 with the double-sided adhesive tape, for example. Specifically, as illustrated in FIG. 17B, the wiping member 135 is bent along the perforation 135C such that the perforation 135C of the wiping member 135 is aligned with the ridge line 136E of the support member 136, thereby placing the wiping member 135 on the support member 136. Accordingly, the oblique surface 135A of the wiping member 135 is placed along the oblique surface 136C of the support member 136, and the oblique surface 135B of the wiping member 135 is placed along the oblique surface 136D of the support member 136. Circular holes 135D and 135E are formed on the wiping member 135 at positions corresponding to the fixing members 138A and 139A. Diameters of the holes 135D and 135E are respectively slightly larger than the diameters of cylinders of the fixing members 138A and 139A. Accordingly, the fixing member 138A of the support member 136 penetrates through the hole 135D of the wiping member 135, and the fixing member 139A of the support member 136 penetrates through the hole 135E of the wiping member 135.

Next, as illustrated in FIG. 17B, heat caulking tools 99 are used to respectively deform the fixing members 138A and 139A. Accordingly, the fixing members 138A and 139A are deformed to crush, and the fixing members 138 and 139 as illustrated in FIG. 17C are obtained. When the fixing members 138A and 139A are deformed in this manner, the holes 135D and 135E of the wiping member 135 are blocked. Accordingly, the wiping member 135 is firmly fixed to the support member 136.

Here, the image formation unit 113 corresponds to one specific example of the "developer container" and the "image formation unit" in the disclosure. The toner storage section 130 corresponds to one specific example of the "container" in the disclosure. The shaft 134 corresponds to one specific example of the "shaft" in the disclosure. The wiping member 135 corresponds to one specific example of the "cleaning member" in the disclosure. The oblique surfaces 135A and 135B respectively correspond to specific examples of "the first oblique surface and the second oblique surface" in the disclosure. The support member 136 corresponds to one specific example of the "support member" in the disclosure. The oblique surfaces 136C and 136D respectively correspond to specific examples of "the third oblique surface and the fourth oblique surface" in the disclosure.

As in the foregoing, in the image formation apparatus 3, the shaft 134 is provided to move in the axis direction, and the oblique surfaces 135A and 135B are provided in the wiping member 135. Accordingly, the shaft 134 moves in the axis direction to adjust the relative positions of the wiping member 135 and the gap S1, thereby making it possible to guide the wiping member 135 to the gap S1. As a result, it is possible to sufficiently wipe the end faces 32B and 33A of the light-guide lenses 32 and 33 in the image formation apparatus 3, so that it is possible to enhance the detection accuracy in detection of the quantity of remaining toner.

Moreover, in the image formation apparatus 3, the width W of the wiping member 135 in an undistorted state is wider than the lens interval SP. This causes the wiping member 135 to be distorted, thereby allowing the high contact pressure of the wiping member 135 to the end face 32B of the light-guide lens 32 and the end face 33A of the light-guide lens 33.

Moreover, in the image formation apparatus 3, it is possible to obtain a suitable contact pressure by setting the inclination angles of the oblique surfaces 135A and 135B to the suitable angles.

Moreover, in the image formation apparatus 3, the shaft 134 is provided to move in the axis direction, and the oblique surfaces 135A and 135B are provided in the wiping member 135. Accordingly, similar to the case of the first embodiment, it is possible to reduce the size of the image formation apparatus 3, and suppress the manufacturing cost of the image formation apparatus 3.

As in the foregoing, in the present embodiment, the shaft is provided to move in the axis direction, and the oblique surfaces are provided in the wiping member. Consequently, it is possible to enhance the detection accuracy in detection of the quantity of remaining toner. Moreover, it is also possible to reduce the size of the image formation apparatus, and suppress the manufacturing cost of the image formation apparatus.

Modification Example 3-1

In the above-mentioned embodiment, although the oblique surfaces 135A and 135B of the wiping member 135 respectively come into contact with the light-guide lenses 32 and 33, thereby guiding the wiping member 135 to the gap S1 between the light-guide lenses 32 and 33, the invention is not limited to this. Instead of this, for example, similar to the case of the first embodiment, the guide member 36 (for example FIG. 6) including oblique surfaces may be provided, and the oblique surfaces 135A and 135B of the wiping member 135 may respectively come into contact with the oblique surfaces of the guide member 36, thereby guiding the wiping member 135 to the gap S1 between the light-guide lenses 32 and 33.

Modification Example 3-2

In the above-mentioned embodiment, although the shaft 34 itself to which the wiping member 35 is fixed moves in the axis direction of the shaft 134, the invention is not limited to this. Instead of this, for example, similar to the case of the second embodiment (FIG. 10), the support member 136 to which the wiping member 135 is fixed may be configured to move relative to the shaft 134 in the axis direction of the shaft 134.

Modification Example 3-3

Figure 18A:
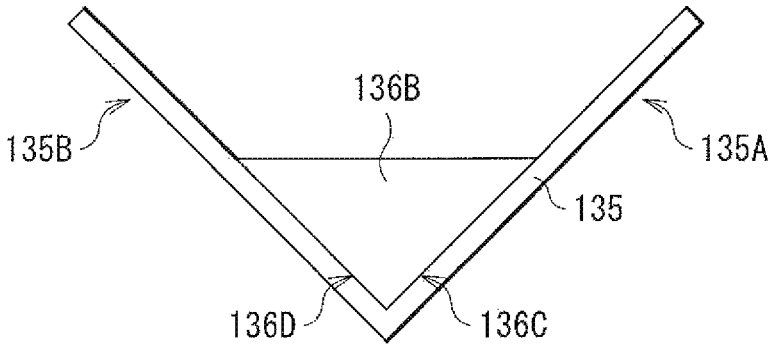
FIG. 18A is an explanation diagram illustrating one configuration example of a wiping member according to a modification example.
Figure 18B:
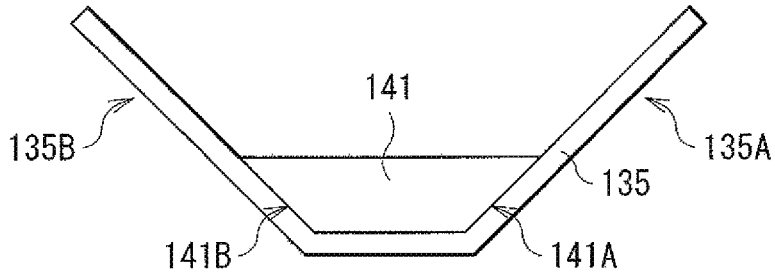
FIG. 18B is an explanation diagram illustrating one configuration example of a wiping member according to another modification example.
Figure 18C:
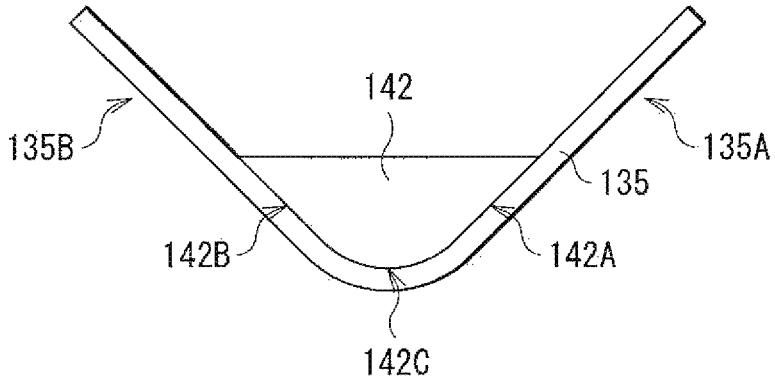
FIG. 18C is an explanation diagram illustrating one configuration example of a wiping member according to another modification example.

In the above-mentioned embodiment, as illustrated in FIG. 18A, although the wiping member 135 is bent in a V-character shape, the invention is not limited to this. Instead of this, for example, as illustrated in FIG. 18B, the wiping member 135 may be bent in multiple stages (two stages, in this example). In this example, an inclination setting part 141 includes oblique surfaces 141A and 141B that are inclined to extend in opposite directions. The inclination setting part 141 sets inclination angles of the oblique surfaces 135A and 135B of the wiping member 135. Moreover, for example, as illustrated in FIG. 18C, the wiping member 135 may be bent along a curved surface 142C. In this example, an inclination setting part 142 includes oblique surfaces 142A and 142B that are inclined to extend in opposite directions. The oblique surfaces 142A and 142B are provided on both sides the curved surface 142C.

Modification Example 3-4

Figure 19:
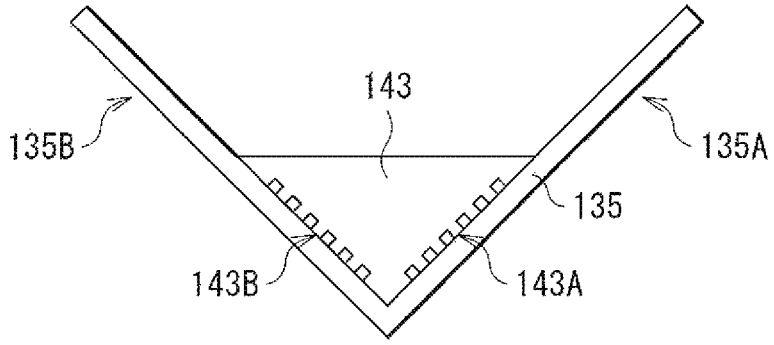
FIG. 19 is an explanation diagram illustrating one configuration example of an inclination setting part according to another modification example.

In the above-mentioned embodiment, although the two oblique surfaces 136C and 136D that are inclined to extend in opposite directions are provided in the inclination setting part 136B, the oblique surfaces 136C and 136D are not necessarily flat surfaces, for example, but may have bumps (irregularities) as on oblique surfaces 143A and 143B of an inclination setting part 143 illustrated in FIG. 19. In this case, surfaces with which the wiping member 135 comes into contact in the inclination setting part 143 correspond to oblique surfaces 143A and 143B.

Modification Example 3-5

Figure 20:
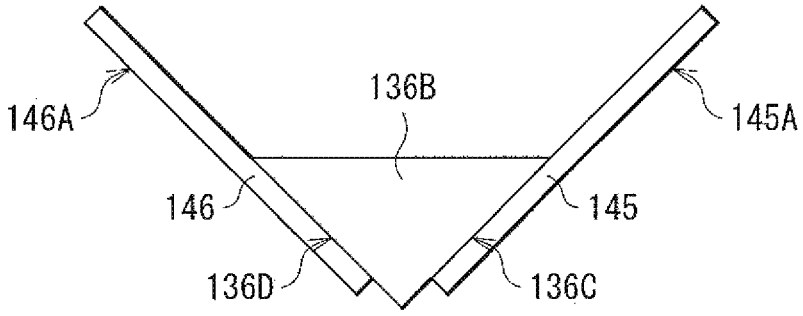
FIG. 20 is an explanation diagram illustrating one configuration example of the wiping member according to another modification example.

In the above-mentioned embodiment, although the oblique surfaces 135A and 1358 are configured by one the wiping member 135 being bent, the invention is not limited to this, for example, as illustrated in FIG. 20, two oblique surfaces 145A and 146A may be configured by using two independent wiping members 145 and 146. The wiping member 145 is placed along the oblique surface 136C of the inclination setting part 1368, and the wiping member 146 is placed along the oblique surface 136D of the inclination setting part 136B.

Modification Example 3-6

The modification examples of the first and second embodiments may be applied to the image formation apparatus 3 according to the above-mentioned embodiment.

4. Fourth Embodiment

Next, an image formation apparatus 4 according to a fourth embodiment is explained. The present embodiment is different from the third embodiment in the method of fixing the wiping member. It should be noted that same reference numerals are given to elements substantially the same as those in the image formation apparatus 3 according to the third embodiment, and explanations thereof are omitted as appropriate.

As illustrated in FIG. 1, the image formation apparatus 4 is provided with four image formation units 153 (image formation units 153C, 153M, 153Y, and 153K). As illustrated in FIG. 12, the image formation unit 153 includes a toner storage section 160. The toner storage section 160 includes a shaft 164 and a wiping member 165.

Figure 21:
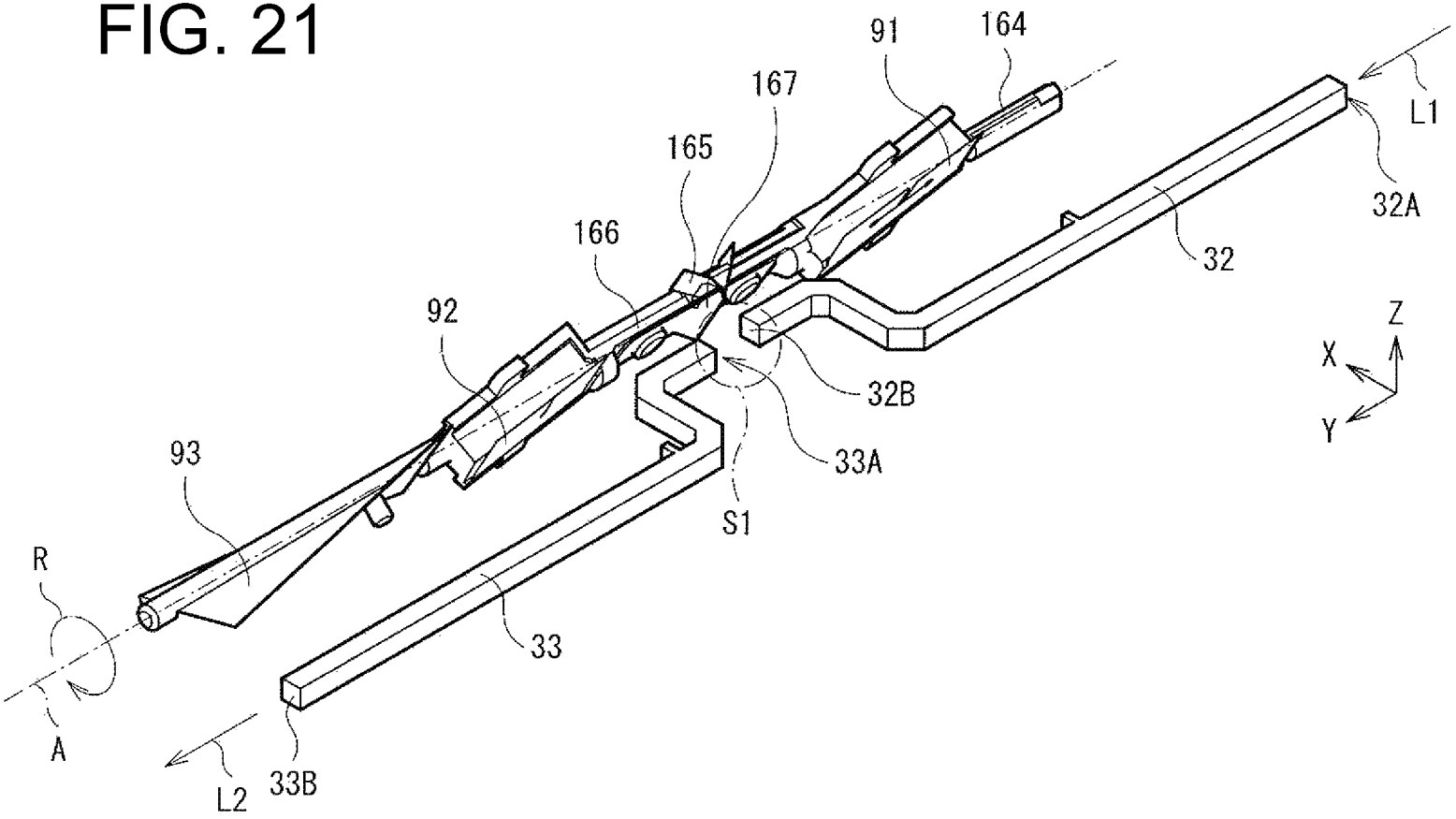
FIG. 21 is a perspective view illustrating one configuration example of a wiping member and a light-guide part according to a fourth embodiment.
Figure 22:
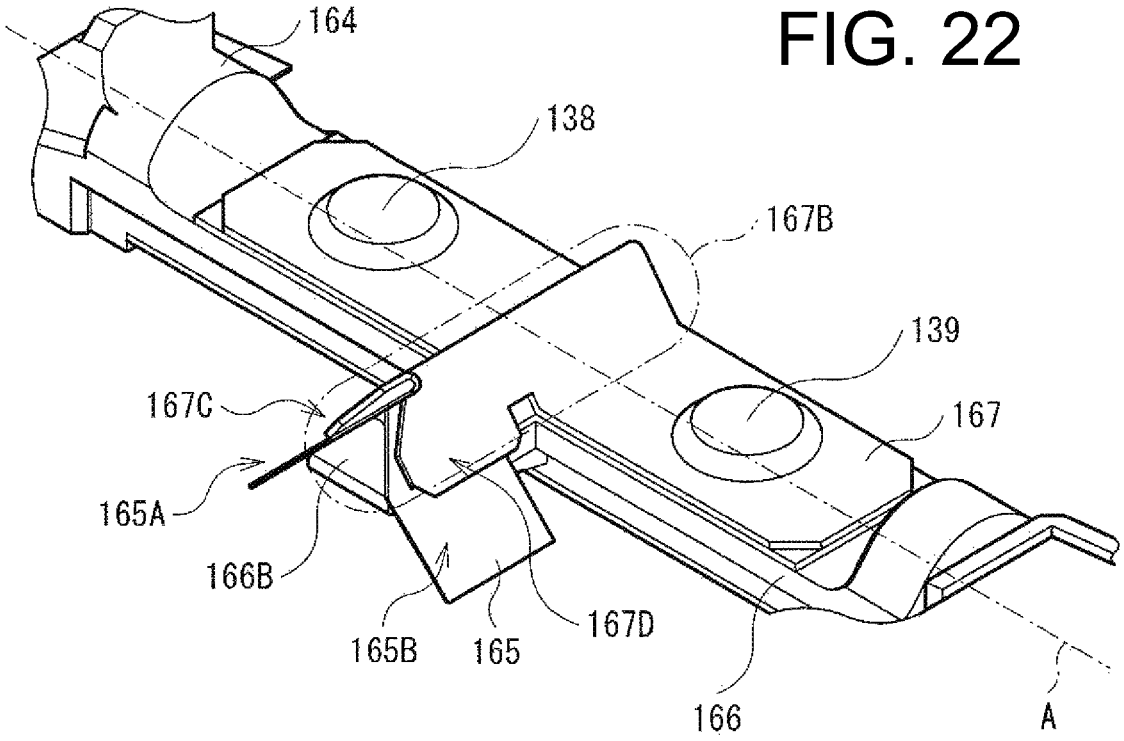
FIG. 22 is a perspective view illustrating one configuration example of the wiping member and a fixing member illustrated in FIG. 21.
Figure 23:
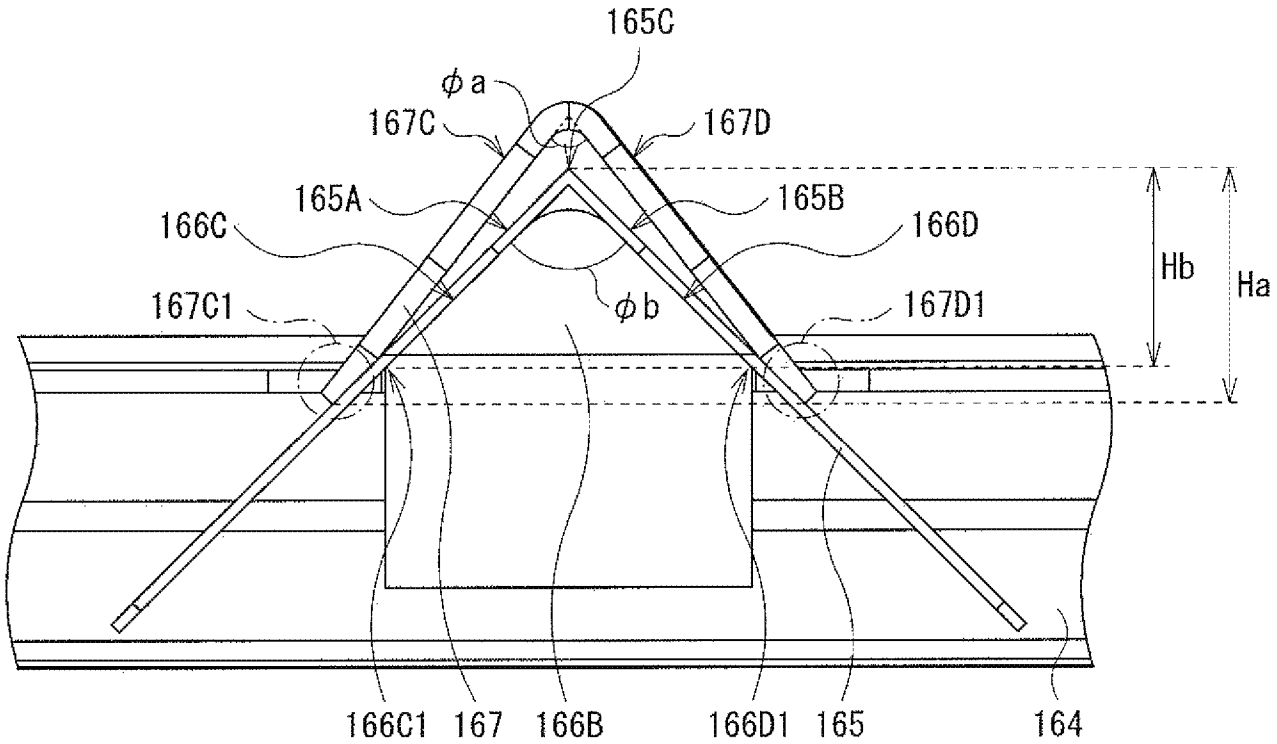
FIG. 23 is a configuration diagram illustrating one configuration example of the wiping member, a support member, and the fixing member illustrated in FIG. 21.

FIG. 21 illustrates one configuration example of the shaft 164, the wiping member 165, and the light-guide part 31. The toner storage section 160 further includes a support member 166 and a fixing member 167. It should be noted that FIG. 21 illustrates wing-shaped stirring members 91 to 93, the illustration of which is omitted in the above-mentioned embodiments. FIGS. 22 and 23 illustrate one configuration example of the wiping member 165 and the fixing member 167.

The shaft 164 serves as a member that is configured to be rotatable about the rotation axis A. The wiping member 165 is attached to the shaft 164. The shaft 164 is configured to move in the axis direction of the shaft 164 similar to the shaft 34 (FIG. 5) according to the first embodiment.

The wiping member 165 serves as a member that cleans the end face 32B of the light-guide lens 32 and the end face 33A of the light-guide lens 33. The wiping member 165 is configured by using, for example, a PTFE film, a PET film, a polystyrene film, a polypropylene film, or a polyimide film, similar to the wiping member 135 according to the third embodiment. The thickness of the wiping member 165 can be set to, for example, equal to or more than 0.05 mm and equal to or less than 0.3 mm. When the polyimide film is used, the thickness of the wiping member 165 can be set to 0.125 mm, for example. The wiping member 165 is fixed to the shaft 164 at a position corresponding to the gap S1 between the light-guide lenses 32 and 33 in the axis direction of the shaft 164, as illustrated in FIG. 21. The wiping member 165 wipes the end face 32B of the light-guide lens 32 and the end face 33A of the light-guide lens 33 with the rotation of the shaft 164 about the rotation axis A.

The wiping member 165 includes two oblique surfaces 165A and 165B that are inclined with respect to the axis direction of the shaft 164 while extending in opposite directions, as illustrated in FIGS. 22 and 23. A ridge line 165C is formed between the oblique surface 165A and the oblique surface 165B as illustrated in FIG. 23. The support member 166 is provided to the shaft 164 at a position corresponding to the gap S1 between the light-guide lenses 32 and 33 in the axis direction of the shaft 164. The wiping member 165 is bonded to the support member 166 using a double-sided adhesive tape, for example, and is pressed and fixed against and to the support member 166 by the fixing member 167. It should be noted that although the wiping member 165 is bonded to the support member 166 in this example, the invention is not limited to this, but for example, a part (for example, the oblique surfaces 165A and 165B) may be configured to not be bonded to the support member 166. The wiping member 165 is guided by the two oblique surfaces 165A and 165B to the gap S1 between the light-guide lenses 32 and 33, similar to the wiping member 135 according to the third embodiment.

The support member 166 serves as a member that supports the wiping member 165. The support member 166 is provided at a position corresponding to the gap S1 between the light-guide lenses 32 and 33 in the axis direction of the shaft 164, and is formed integrally with the shaft 164, in this example. The support member 166 includes an inclination setting part 166B, similar to the support member 136 (FIG. 17A) according to the third embodiment. The inclination setting part 166B includes two oblique surfaces 166C and 166D that are inclined with respect to the axis direction of the shaft 164 while extending in opposite directions like V-shape as illustrated in FIG. 23. The oblique surface 166C and the oblique surface 166D are inclined to form an angle φb. The two oblique surfaces 165A and 165B of the wiping member 165 are placed respectively along the two oblique surfaces 166C and 166D of the support member 166, similar to the oblique surfaces 135A and 135B (FIGS. 17A and 17B) according to the third embodiment. In other words, the two oblique surfaces 165A and 165B of the wiping member 165 are also inclined to form the angle φb. In this manner, the support member 166 supports the oblique surfaces 165A and 165B of the wiping member 165.

The fixing member 167 serves as a member that fixes the wiping member 165 to the support member 166. The fixing member 167 is configured by using a sheet metal such as stainless steel, for example. The thickness of the sheet can be set to, for example, equal to or more than 0.05 mm and equal to or less than 0.5 mm. In this example, the thickness of the sheet metal is set to 0.2 mm. The fixing member 167 includes an oblique surface fixing part 167B. The oblique surface fixing part 167B includes oblique surfaces 167C and 167D. The oblique surfaces 167C and 167D are inclined with respect to the axis direction of the shaft 164 while extending in opposite directions, and are inclined to form an angle (pa (FIG. 23). One end of the oblique surface 167C and one end of the oblique surface 167D are coupled to each other. Accordingly, the oblique surface fixing part 167B has an approximate V-character shape. The oblique surfaces 167C and 167D of the fixing member 167 are placed over a part of the oblique surfaces 165A and 165B of the wiping member 165, which is described later. The oblique surface 167C of the fixing member 167 is placed at a position corresponding to the oblique surface 165A of the wiping member 165, and the oblique surface 167D of the fixing member 167 is placed at a position corresponding to the oblique surface 165B of the wiping member 165. Moreover, the fixing member 167 and the wiping member 165 are fixed to the support member 166 by the fixing members 138 and 139, similar to the case of the third embodiment (FIGS. 17A to 17C). Accordingly, the fixing member 167 presses and fixes the oblique surfaces 165A and 1658 of the wiping member 165 against and to the inclination setting part 1668 of the support member 166.

The acute angle φa and the acute angle φb are set to satisfy the following expression (2).

$$0<\varphi a<\varphi b<180 \quad (2)$$

Accordingly, an end portion 167C1 of the oblique surface 167C of the fixing member 167 presses the oblique surface 165A of the wiping member 165 against the inclination setting part 1668 of the support member 166, and an end portion 167D1 of the oblique surface 167D of the fixing member 167 presses the oblique surface 1658 of the wiping member 165 against the inclination setting part 1668 of the support member 166. The oblique surface fixing part 1678 of the fixing member 167 has an approximate V-character shape, so that the spring property (elastic force) of the oblique surface fixing part 1678 generates downward forces in FIG. 23 at the end portions 167C1 and 167D1. In this manner, the fixing member 167 is configured to press, with the spring property (elastic force) of the oblique surface fixing part 1678, the oblique surfaces 165A and 1658 of the wiping member 165 against the inclination setting part 1668 of the support member 166.

Moreover, as illustrated in FIG. 23, when a height from end faces of the end portions 167C1 and 167D1 of the oblique surfaces 167C and 167D in the fixing member 167 to the ridge line 165C of the wiping member 165 is set as a height Ha, and a height from the end portion 166C1 (deformation support point) of the oblique surface 166C and an end portion 166D1 (deformation support point) of the oblique surface 166D in the inclination setting part 1668 of the support member 166 to the ridge line 165C of the wiping member 165 is set as a height Hb, the heights Ha and Hb are set to satisfy the following expression (3).

$$Ha>Hb \quad (3)$$

Accordingly, when the fixing member 167 presses the wiping member 165 against the inclination setting part 1668 of the support member 166, the oblique surface 165A of the wiping member 165 is distorted at the end portion 166C1 of the oblique surface 166C as a deformation support point, and the oblique surface 165B of the wiping member 165 is distorted at the end portion 166D1 of the oblique surface 166D as a deformation support point. In other words, the oblique surfaces 165A and 165B of the wiping member 165 is distorted to narrow an angle formed by the oblique surfaces 165A and 165B. To put it differently, the oblique surfaces 165A and 165B is distorted by being pressed against the oblique surfaces 166C and 166D of the support member 166. As a result, the fixing member 167 is configured to more strongly press the wiping member 165 together with the inclination setting part 166B of the support member 166.

Here, the fixing member 167 corresponds to one specific example of the "fixing member" in the disclosure. The support member 166 corresponds to one specific example of the "support member" in the disclosure.

In the image formation apparatus 4, the fixing member 167 including the oblique surfaces 167C and 167D is provided, and the fixing member 167 is placed over a part of the oblique surfaces 165A and 165B of the wiping member 165. Accordingly, it is possible to reduce the size of the image formation apparatus 4. In other words, for example, in the image formation apparatus 3 according to the third embodiment, for example, narrowing down the lens interval SP and the width of the inclination setting part 136B in the support member 136 in order to reduce the size of the apparatus reduces an area in which the oblique surfaces 135A and 135B of the wiping member 135 and the oblique surfaces 136C and 136D of the inclination setting part 136B are bonded to each other. Therefore, for example, the image formation apparatus 3 is used for a long period of time to cause such a risk that bonding between the wiping member 135 and the inclination setting part 136B may be easily peeled off. When the bonding is peeled off, for example, the position of the wiping member 135 is shifted to result in an insufficient contact between the wiping member 135 and the end faces 32B and 33A in the light-guide part 31. Accordingly, there is a risk that the wiping becomes insufficient. As a result, the detection accuracy in detection of the quantity of toner remaining in the toner storage section 160 may be lowered.

In contrast, in the image formation apparatus 4, the fixing member 167 is provided, so that it is possible to strongly press the wiping member 165 against the inclination setting part 166B of the support member 166. Accordingly, in the image formation apparatus 4, the wiping member 135 can be fixed to a desired position, so that it is possible to reduce the risk that the wiping becomes insufficient. As a result, it is possible to reduce the size of the image formation apparatus 4.

As in the foregoing, in the present embodiment, the fixing member 167 including the oblique surfaces 167C and 167D is provided, and the fixing member 167 is placed over a part of the oblique surfaces 165A and 1658 of the wiping member. Consequently, it is possible to reduce the size of the image formation apparatus.

Modification Example 4-1

In the above-mentioned embodiment, although the oblique surfaces 165A and 1658 of the wiping member 165 come into contact with the light-guide lenses 32 and 33, thereby guiding the wiping member 165 to the gap S1 between the light-guide lenses 32 and 33, the invention is not limited to this. Instead of this, for example, similar to the case of the first embodiment, the guide member 36 (for example FIG. 6) including oblique surfaces may be provided, and the oblique surfaces 165A and 1658 of the wiping member 165 may respectively come into contact with the oblique surfaces of the guide member 36, thereby guiding the wiping member 165 to the gap S1 between the light-guide lenses 32 and 33.

Modification Example 4-2

In the above-mentioned embodiment, although the shaft 164 itself to which the wiping member 165 is fixed moves in the axis direction of the shaft 164, the invention is not limited to this. Instead of this, for example, similar to the case of the second embodiment (FIG. 10), the support member 166 to which the wiping member 165 is fixed may be configured to move relative to the shaft 164 in the axis direction of the shaft 164.

Modification Example 4-3

The modification examples of the first to third embodiments may be applied to the image formation apparatus 4 according to the above-mentioned embodiment.

5. Fifth Embodiment

Next, an image formation apparatus 5 according to the fifth embodiment is explained. The present embodiment is obtained such that the transmission method of the power to the shaft to which the wiping member is provided is devised in the image formation apparatus 4 according to the fourth embodiment, for example. It should be noted that same reference numerals are given to elements substantially the same as those in the image formation apparatus 4 according to the fourth embodiment, and explanations thereof are omitted as appropriate.

As illustrated in FIG. 1, the image formation apparatus 5 is provided with four image formation units 173 (image formation units 173C, 173M, 173Y, and 173K). As illustrated in FIG. 12, the image formation unit 173 includes the toner storage section 160. The toner storage section 160 includes the shaft 164 and the wiping member 165.

Figure 24:
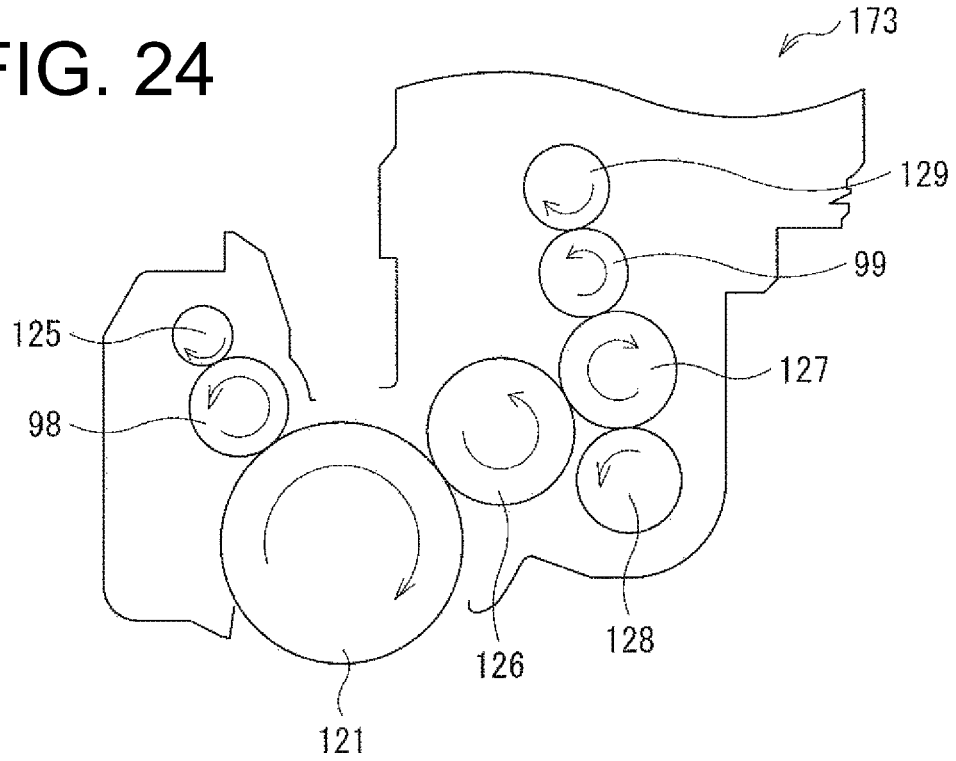
FIG. 24 is a configuration diagram illustrating one configuration example of gears in an image formation unit according to a fifth embodiment.

FIG. 24 illustrates one configuration example of gears in the image formation unit 173. The image formation unit 173 includes gears 121, 97, 125, 126, 127, 127, 98, and 129. These gears each have, for example, multiple gear teeth, and the gears mesh with each other with their teeth to transmit the power between the different gears.

The gear 121 serves as a member that transmits the power to the photoconductive drum 21. The gear 121 rotates in a clockwise direction in this example, based on the power transmitted from the drum motor, which is not illustrated.

The gear 97 serves as a member that transmits the power transmitted from the gear 121 to the gear 125. The gear 97 is provided at a position where the charge roller 24 is placed, and rotates in a counter-clockwise direction independent of the charge roller 24.

The gear 125 serves as a member that transmits the power to the auxiliary roller 25. The gear 125 rotates in a clockwise direction based on the power transmitted from the gear 97, in this example.

The gear 126 serves as a member that transmits the power to the development roller 26. The gear 126 rotates in a counter-clockwise direction based on the power transmitted from the gear 121, in this example.

The gear 127 serves as a member that transmits the power to the stirring bar 37. The gear 127 rotates in a clockwise direction based on the power transmitted from the gear 126, in this example.

The gear 128 serves as a member that transmits the power to the supply roller 28. The gear 128 rotates in a counter-clockwise direction based on the power transmitted from the gear 127, in this example.

The gear 98 serves as a member that transmits the power transmitted from the gear 127 to the gear 129. The gear 98 rotates in a counter-clockwise direction.

The gear 129 serves as a member that transmits the power to the shaft 164. The gear 129 rotates in a clockwise direction based on the power transmitted from the gear 98, in this example.

Figure 25:
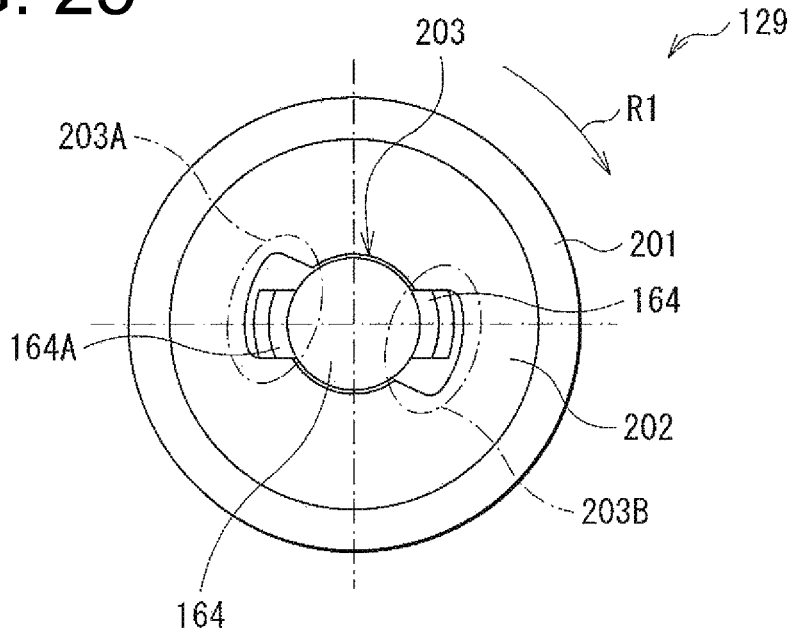
FIG. 25 is a configuration diagram illustrating one configuration example of the gear according to a fifth embodiment.

FIG. 25 illustrates one configuration example of the shaft 164 and the gear 129.

The shaft 164 includes two protrusion parts 164A and 164B, as illustrated in FIG. 25. The protrusion parts 164A and 164B are placed on an end portion of the shaft 164, and protrude respectively in directions that intersect the axis direction.

The gear 129 includes a gear part 201 and a power transmission part 202. The gear part 201 includes multiple gear teeth (not illustrated), and receives the power transmitted from the gear 98 by these gear teeth meshing with the plurality of gear teeth of the gear 98. The gear part 201 is placed in the outside of the power transmission part 202 in the gear 129.

The power transmission part 202 transmits the power received by the gear part 201 to the shaft 164. The power transmission part 202 is placed in the inside of the gear part 201 in the gear 129. The power transmission part 202 includes a housing part 203 that houses (stores) the end portion of the shaft 164. The housing part 203 includes protrusion housing parts 203A and 203B. The protrusion housing part 203A houses the protrusion part 164A of the shaft 164, and the protrusion housing part 203B houses the protrusion part 164B thereof. The width of the protrusion housing part 203A in the rotation direction of the gear 129 is formed wider than the width of the protrusion part 164A in the rotation direction of the gear 129. Similarly, the width of the protrusion housing part 203B in the rotation direction of the gear 129 in the rotation direction of the gear 129 is formed wider than the width of the protrusion part 164B.

This configuration enables the gear 129 to rotate within a predetermined angle range a between the gear part 201 and the shaft 164. In other words, the gear 129 includes what is called play in the rotation direction, between the gear part 201 and the shaft 164. The angle range a is set to, for example, about 20 degrees.

As illustrated in FIG. 7, the image formation apparatus 5 is provided with a motor controller 155. The motor controller 155 controls, based on the instruction from the controller 59, operations of various kinds of motors such as the drum motor and the belt motor in the image formation apparatus 5. The motor controller 155 has a function of causing the drum motor to normally rotate, and causing the drum motor to reversely rotate only in a short period of time after causing the four image formation units 173 to perform the image formation operations. This can remove coagulated matters (solidified matters) of toner between the development roller 26, and the development blade 27 abutted on the development roller 26, for example, in each image formation unit 173. As a result, it is possible to enhance the image quality of the image formed on the recording medium 9, in the image formation apparatus 5.

Here, the gear 129 corresponds to one specific example of the "gear member" in the disclosure. The gear part 201 corresponds to one specific example of the "gear part" in the disclosure. The power transmission part 202 corresponds to one specific example of the "transmission part" in the disclosure. The housing part 203 corresponds to one specific example of the "housing part" in the disclosure.

When the image formation unit 173 performs the image formation operation, as illustrated in FIG. 25, the gear 129 rotates in a rotation direction R1 (clockwise direction). Accordingly, as illustrated in FIG. 25, a wall surface of the protrusion housing part 203A and the protrusion part 164A come into contact with each other on an upstream side of the rotation direction R1 in the protrusion housing part 203A, and a clearance is generated on a downstream side of the rotation direction R1 in the protrusion housing part 203A. Similarly, a wall surface of the protrusion housing part 203B and the protrusion part 164B come into contact with each other on an upstream side of the rotation direction R1 in the protrusion housing part 203B, and a clearance is generated on a downstream side of the rotation direction R1 in the protrusion housing part 203B. With the contact between the wall surface of the protrusion housing part 203A and the protrusion part 164A, and the contact between the wall surface of the protrusion housing part 203B and the protrusion part 164B, the gear 129 transmits the power received by the gear part 201 to the shaft 164. Accordingly, the shaft 164 rotates in the rotation direction R1 (clockwise direction) based on the power received by the gear part 201.

Next, one operation example of the shaft 164 and the gear 129 in a case where the drum motor reversely rotates only in a short period of time after the image formation unit 173 has performed the image formation operation, is explained.

Figure 26A:
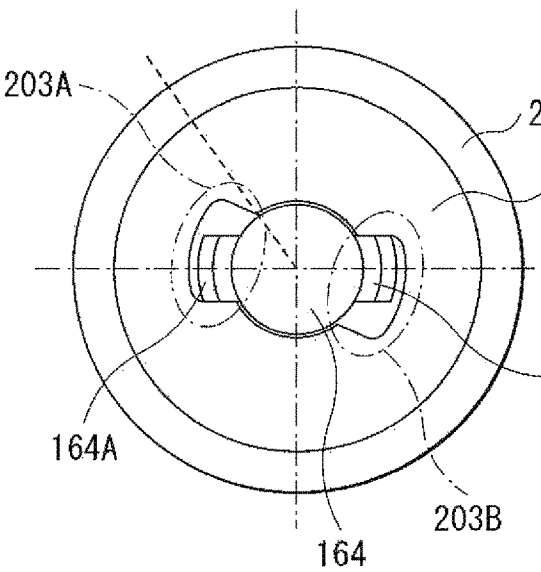
FIGS. 26A to 26C are explanation diagrams illustrating one operation example of the gear illustrated in FIG. 25.
Figure 26B:
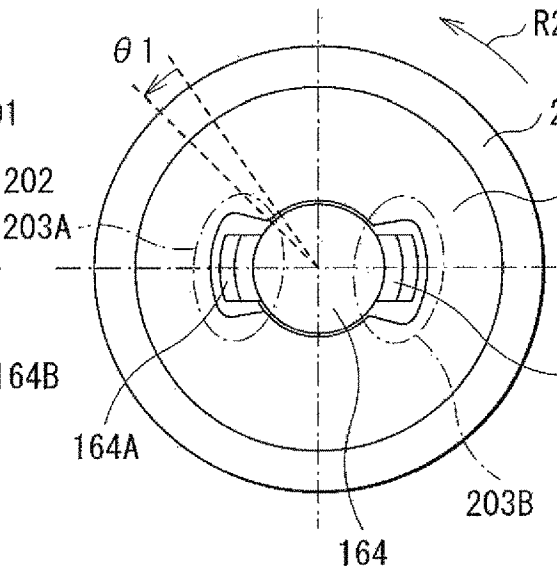
Figure 26C:
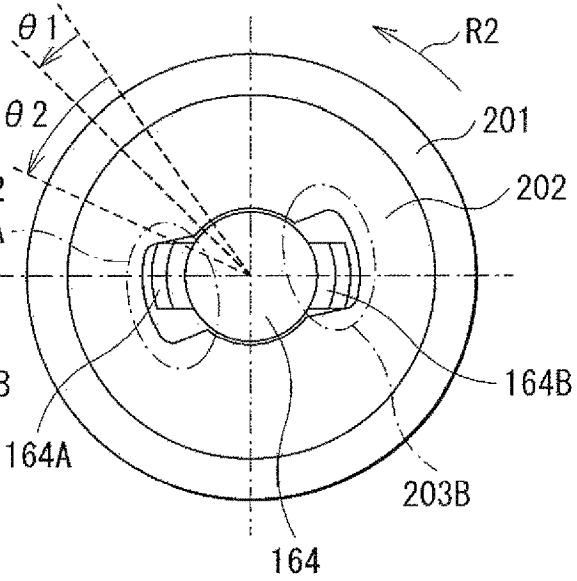

FIGS. 26A to 26C illustrate operation examples of the shaft 164 and the gear 129. FIG. 26A illustrates a state at the timing when a rotation operation of the gear 129 in the rotation direction R1 is stopped, FIG. 26B illustrates a case where the gear 129 rotates in a rotation direction R2 that is opposite to the rotation direction R1 by an angle 81, and FIG. 26C illustrates a case where the gear 129 rotates in the rotation direction R2 by an angle 82 that is equivalent to the predetermined angle range a.

When the image formation unit 173 performs the image formation operation, as illustrated in FIG. 25, the gear 129 rotates in the rotation direction R1 (clockwise direction). Further, when the normal rotation of the drum motor is stopped, the rotation operation of the gear 129 is stopped. At the timing when the rotation operation of the gear 129 is stopped, as illustrated in FIG. 26A, a position of the protrusion part 164A of the shaft 164 in the protrusion housing part 203A, and a position of the protrusion part 164B of the shaft 164 in the protrusion housing part 203B are similar to the positions (FIG. 25) in the image formation operation. In FIG. 26A, an orientation of the gear 129 in this process is indicated by a dashed line.

Next, the drum motor reversely rotates only in a short period of time to cause the gear 129 to rotate in the rotation direction R2 (counter-clockwise direction) that is opposite to the rotation direction R1 by an angle θ1. This angle θ1 is determined based on a rotation angle when the drum motor reversely rotates, and a gear ratio when the power is transmitted from the gear 121 to the gear 129. The angle θ1 is about 8 degrees, in this example. In other words, the angle θ1 is smaller than the angle range a ($\theta 1<\alpha$). In this case, as illustrated in FIG. 26B, the protrusion part 164A does not come into contact with the wall surface of the protrusion housing part 203A in the protrusion housing part 203A, and similarly, the protrusion part 164B does not come into contact with the wall surface of the protrusion housing part 203B in the protrusion housing part 203B. Therefore, the shaft 164 does not rotate.

It should be noted that for example, when the gear 129 rotates in the rotation direction R2 (counter-clockwise direction) by an angle 82 that is equivalent to the predetermined angle range a, as illustrated in FIG. 26C, the wall surface of the protrusion housing part 203A and the protrusion part 164A come into contact with each other on an upstream side of the rotation direction R2 in the protrusion housing part 203A, and the wall surface of the protrusion housing part 203B and the protrusion part 164B come into contact with each other on an upstream side of the rotation direction R2 in the protrusion housing part 203B. Therefore, when the rotation angle of the gear 129 is equal to or less than the angle θ2 (=α), it is possible to prevent the shaft 164 from rotating.

In this manner, in the image formation apparatus 5, the gear 129 is configured to be turnable within the predetermined angle range a between the gear part 201 and the shaft 164. Accordingly, it is possible to reduce a risk that the wiping member 165 may be damaged due to the reverse rotation of the drum motor, as is explained later.

Figure 27:
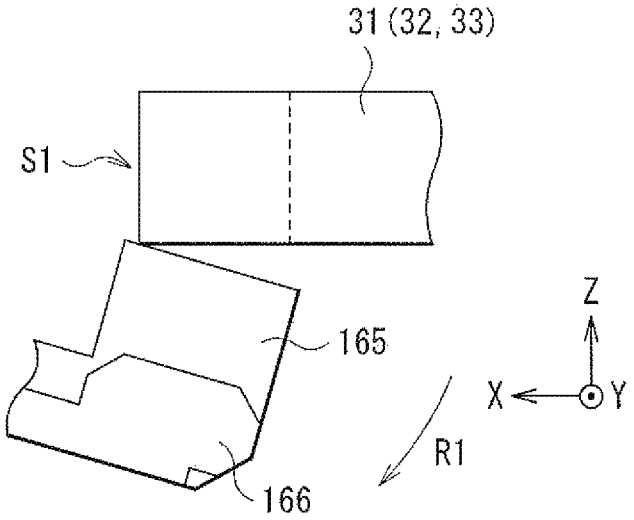
FIG. 27 is an explanation diagram illustrating one operation example of the image formation unit according to a fifth embodiment.

FIG. 27 illustrates one example of a positional relationship between the wiping member 165 and the light-guide part 31 immediately after the normal rotation of the drum motor is stopped. In this example, immediately after the wiping member 165 passes through the gap S1 in the light-guide part 31, the drum motor stops the normal rotation, and starts the reverse rotation. Because the shaft 164 does not rotate even if the drum motor reversely rotates in this manner, the position of the wiping member 165 remains at the position immediately after the wiping member 165 passes through the gap S1 between the light-guide lenses 32 and 33, as illustrated in FIG. 27. Consequently, in the image formation apparatus 5, it is possible to reduce a risk that the wiping member 165 may be damaged.

In other words, for example, in a configuration where the gear 129 is not allowed to turn between the gear part 201 and the shaft 164, a reverse rotation of the drum motor causes the shaft 164 to rotate in the rotation direction R2 that is opposite to the rotation direction R1. Therefore, when the reverse rotation of the drum motor is started immediately after the wiping member 165 passes through the gap S1, the wiping member 165 starts to move in a direction (upward direction in FIG. 27) reverse to the normal wiping operation, and the wiping member 165 collides with the light-guide lenses 32 and 33 of the light-guide part 31. As similar to the case of the third embodiment (FIG. 15), because the width W of the wiping member 165 in an undistorted state is wider than the lens interval SP, the wiping member 165 collides with the light-guide part 31 to apply the force in the reverse direction of the force in the wiping operation to the oblique surfaces 165A and 165B of the wiping member 165, for example. Accordingly, there is a risk that the wiping member 165 may be damaged. When the wiping member 165 is damaged, the detection accuracy in detection of the quantity of toner remaining in the toner storage section 160 is lowered.

In contrast, in the image formation apparatus 5, the gear 129 is configured to be turnable within the predetermined angle range between the gear part 201 and the shaft 164*a*. Accordingly, it is possible to prevent the shaft 164 from rotating even if the drum motor reversely rotates. This prevents the wiping member 165 from colliding with the light-guide part 31 in the image formation apparatus 5, so that it is possible to reduce a risk that the wiping member 165 may be damaged. As a result, in the image formation apparatus 5, it is possible to reduce the risk that the detection accuracy in detection of the quantity of toner remaining in the toner storage section 160 may be lowered.

Moreover, for example, also in a case where the normal rotation of the drum motor stops while the wiping member 165 is wiping the end faces 32B and 33A of the light-guide part 31, as is explained later, it is possible to prevent the wiping member 165 from deforming.

Figure 28A:
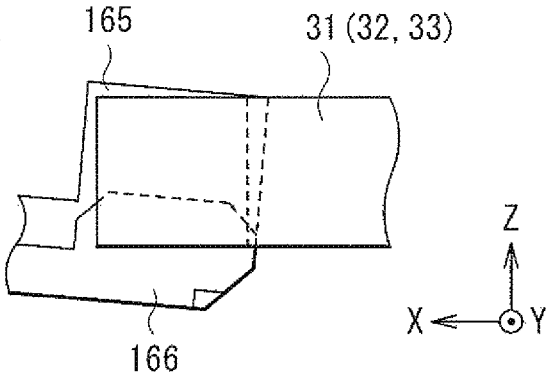
FIG. 28A is an explanation diagram illustrating another operation example of the image formation unit according to a fifth embodiment.
Figure 28B:
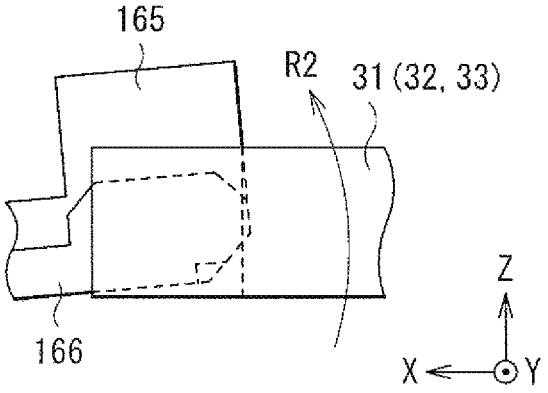
FIG. 28B is an explanation diagram illustrating another operation example of the image formation unit according to a fifth embodiment.

FIG. 28A illustrates one example of a positional relationship between the wiping member 165 and the light-guide part 31 immediately after the normal rotation of the drum motor is stopped, and FIG. 28B illustrates one example of a positional relationship between the wiping member 165 and the light-guide part 31 at timing after the timing illustrated in FIG. 28A. In this example, the normal rotation of the drum motor is stopped while the wiping member 165 is passing through the gap S1 between the light-guide lenses 32 and 33. In this case, the wiping member 165 is sandwiched between the end face 32B of the light-guide lens 32 and the end face 33A of the light-guide lens 33 in the gap S1, and thus is distorted. At this time, a force to return to an original undistorted state is generated in the oblique surfaces 165A and 165B of the wiping member 165. This generates a force in the upward direction in FIG. 28A, in the wiping member 165. In the image formation apparatus 5, as illustrated in FIG. 28B, the wiping member 165 can move in the rotation direction R2 according to the force in the upward direction. Consequently, it is possible to reduce the risk that the plastic deformation (creep) may occur in the wiping member 165.

In other words, for example, in a configuration where the gear 129 is not allowed to turn between the gear part 201 and the shaft 164, even when a force in the upward direction in FIG. 28A is generated in the wiping member, the shaft 164 is unable to rotate. Accordingly, the wiping member 165 remains being sandwiched between the end face 32B of the light-guide lens 32 and the end face 33A of the light-guide lens 33. In this case, because the wiping member 165 is continuously distorted, there is a risk that the plastic deformation may occur. When the plastic deformation of the wiping member 165 occurs in this manner, the detection accuracy in detection of the quantity of toner remaining in the toner storage section 160 is lowered.

In contrast, in the image formation apparatus 5, the gear 129 is configured to be turnable within the predetermined angle range a between the gear part 201 and the shaft 164. Accordingly, when a force in the upward direction in FIG. 28A is generated in the wiping member 165, the shaft 164 can rotate in the rotation direction R2. Accordingly, in the image formation apparatus 5, as illustrated in FIG. 28B, the wiping member 165 can move in the rotation direction R2, so that the distorted state of the wiping member 165 can be resolved to some extent. Consequently, it is possible to reduce the risk that the plastic deformation (creep) may occur in the wiping member 165. As a result, in the image formation apparatus 5, it is possible to reduce the risk that the detection accuracy in detection of the quantity of toner remaining in the toner storage section 160 may be lowered.

As in the foregoing, in the present embodiment, the gear 129 is configured to be turnable within the predetermined angle range between the gear part 201 and the shaft 164, so that it is possible to reduce the risk that the wiping member may be damaged or plastically deformed. Consequently, it is possible to reduce the risk that the detection accuracy may be lowered.

Modification Example 5-1

In the above-mentioned embodiment, although the image formation apparatus 5 is configured by using the wiping member 165 (for example, FIG. 22 and others) according to the fourth embodiment, the invention is not limited to this. Instead of this, for example, the image formation apparatus 5 may be configured by using the wiping member 35 (for example, FIG. 6) according to the first embodiment. Also in this case, for example, the wiping member 35 does not collide with the light-guide part 31 when the drum motor reversely rotates, so that it is possible to reduce the risk that the wiping member 35 may be damaged. As a result, it is possible to reduce the risk that the detection accuracy in detection of the quantity of remaining toner may be lowered.

Modification Example 5-2

Figure 29:
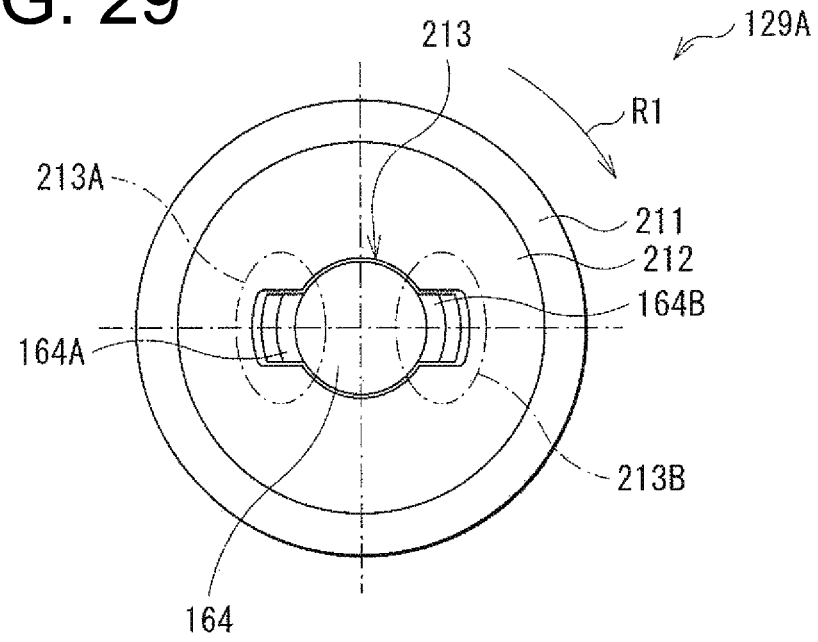
FIG. 29 is a configuration diagram illustrating one configuration example of a gear according to a modification example of a fifth embodiment.

In the above-mentioned embodiment, as illustrated in FIG. 25, although the width of the protrusion housing part 203A in the rotation direction of the gear 129 is set to be wider than the width of the protrusion part 164A in the rotation direction of the gear 129, and the width of the protrusion housing part 203B in the rotation direction of the gear 129 is set to be wider than the width of the protrusion part 1648 in the rotation direction of the gear 129, so that the gear 129 is configured to be turnable within the predetermined angle range a between the gear part 201 and the shaft 164, the invention is not limited to this. Instead of this, for example, what is called a one-way gear may be used. FIG. 29 illustrates one configuration example of a gear 129A according to a modification example. The gear 129A includes a gear part 211, and a power transmission part 212. The gear part 211 includes multiple gear teeth (not illustrated), and receives the power transmitted from the gear 98 by these gear teeth meshing with the plurality of gear teeth of the gear 98. The power transmission part 212 transmits the power received by the gear part 211 to the shaft 164. The power transmission part 212 is configured to rotate along with the rotation of the gear part 211 when the gear part 211 rotates in the rotation direction R1, and not to rotate when the gear part 211 rotates in a direction opposite to the rotation direction R1. The power transmission part 212 includes a housing part 213 that houses the end portion of the shaft 164. The housing part 213 includes protrusion housing parts 213A and 213B. The protrusion housing part 213A houses the protrusion part 164A of the shaft 164, and the protrusion housing part 2138 houses the protrusion part 1648 of the shaft 164. The width of the protrusion housing part 213A in the rotation direction of the gear 129A is approximately the same as the width of the protrusion part 164A in the rotation direction of the gear 129A, and similarly, the width of the protrusion housing part 2138 in the rotation direction of the gear 129A is approximately the same as the width of the protrusion part 1648 in the rotation direction of the gear 129A.

Although the present technique has been explained in the foregoing with the some embodiments and modification examples, the present technique is not limited to these embodiments and others, and various modifications are possible.

For example, in the above-mentioned embodiments and others, although a color image is formed on the recording medium 9, the invention is not limited to this, but a monochrome image may be formed.

For example, in the above-mentioned embodiments and others, although the present technique is applied to a printer having a single function, the invention is not limited to this. Instead of this, the present technique may be applied to a what is called multi-function peripheral (MFP) having a copying function, a faxing function, a scanning function, a printing function, and other functions, for example.

For example, in the above-mentioned embodiments and others, although a toner image formed by the image formation unit 13 is directly transferred onto the recording medium 9, the invention is not limited to this. Instead of this, for example, a toner image formed by the image formation unit may be temporarily transferred onto an intermediate transfer belt, and the toner image having been transferred on the intermediate transfer belt may be transferred onto the recording medium 9.

For example, in the above-mentioned embodiments and others, the width W of the wiping member 35, the lens interval SP, the guide widths W1 and W2 of the guide member 36, the voltage of the light detecting signal DET, and others are merely examples, and may be changed as appropriate.

With a first developer container, a first image formation unit, a first image formation apparatus provided with the first developer container, and a second image formation apparatus provided with the first image formation unit, in one embodiment of the present disclosure, a cleaning member that is movable in a first direction, and a guide member that guides the cleaning member to a gap space between a first end face and a second end face are provided. Consequently, it is possible to enhance the detection accuracy in detection of the quantity of the remaining developer.

With a second developer container, a second image formation unit, a first image formation apparatus provided with the second developer container, and a second image formation apparatus provided with the second image formation unit in one embodiment of the present disclosure, a cleaning member that is movable in the first direction, and includes a first oblique surface and a second oblique surface that are inclined with respect to the first direction while extending in opposite directions are provided. Consequently, it is possible to enhance the detection accuracy in detection of the quantity of the remaining developer.

With a third developer container, and a first image formation apparatus provided with the third developer container in one embodiment of the present disclosure, a cleaning member that includes a first oblique surface and a second oblique surface that are inclined with respect to the first direction while extending in opposite directions is provided. Consequently, it is possible to enhance the detection accuracy in detection of the quantity of the remaining developer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer container comprising:

a container defining therein a space containing a developer;

an optical system that includes a first optical member which includes a first end face exposed to the containing space in the container, and from which light is emitted through the first end face, and a second optical member which includes a second end face exposed to the containing space and being opposed to the first end face in a first direction, and on which the light is incident through the second end face;

a shaft that is provided in the containing space, and that is rotatable about a rotation axis extending along the first direction;

a cleaning member that is provided to the shaft, and that is movable in the first direction along the rotation axis, and cleans the first end face and the second end face by passing through a gap between the first end face and the second end face with a rotation of the shaft; and a guide member that is provided upstream of the optical system in a rotation direction of the shaft, and that comes into contact with the cleaning member to guide the cleaning member to the gap.

2. The developer container according to claim 1, further comprising a first bearing part including a first bearing hole with a bottom portion that supports a first end portion of the shaft, and a second bearing part that includes a second bearing hole with a bottom portion that supports a second end portion of the shaft, wherein a distance between the bottom portion of the first bearing hole and the bottom portion of the second bearing hole is longer than a length of the shaft in the first direction, such that the shaft is movable along the first direction, wherein the bottom portion of the first bearing hole and the bottom portion of the second bearing hole are opposed to each other in the first direction, and the cleaning member is fixed to the shaft so that the cleaning member is movable along the first direction with movement of the shaft along the first direction.

3. The developer container according to claim 1, wherein a guide width of the guide member on an upstream end in the rotation direction of the shaft is wider than a guide width of the guide member on a downstream end in the rotation direction of the shaft.

4. A developer container comprising:

a container defining therein a space containing a developer;

an optical system that includes a first optical member which includes a first end face exposed to the containing space in the container, and from which light is emitted through the first end face, and a second optical member which includes a second end face exposed to the containing space, and being opposed to the first end face in a first direction, and on which the light is incident through the second end face;

a shaft that is provided in the containing space, and that is rotatable about a rotation axis extending along the first direction; and a cleaning member that is provided to the shaft, that includes a first oblique surface and a second oblique surface being inclined with respect to the first direction while extending in opposite directions, and that cleans the first end face and the second end face by passing through a gap between the first end face and the second end face with a rotation of the shaft, wherein a first distance between the first and second oblique surfaces on an upstream side, in the rotation direction, of the cleaning member is larger than a second distance between the first and second oblique surfaces on a downstream side, in the rotation direction, of the cleaning member.

5. The developer container according to claim 4, further comprising a support member that is provided to the shaft, that includes a third oblique surface and a fourth oblique surface being inclined with respect to the first direction while extending in opposite directions, and that supports the cleaning member, wherein a portion of the cleaning member corresponding to the first oblique surface is placed along the third oblique surface of the support member, and a portion of the cleaning member corresponding to the second oblique surface is placed along the fourth oblique surface of the support member.

6. The developer container according to claim 4, further comprising a fixing member that fixes the cleaning member by being placed over a part of the first and second oblique surfaces of the cleaning member.

7. The developer container according to claim 5, further comprising a fixing member that fixes the cleaning member to the support member by being placed over a part of the first and second oblique surfaces of the cleaning member, wherein an inner angle of a ridge of the fixing member is smaller than an inner angle of a ridge of the support member.

8. The developer container according to claim 4, wherein the cleaning member is movable along the first direction.

9. The developer container according to claim 8, wherein the cleaning member is movable along the first direction according to a force generated in the cleaning member by the first oblique surface coming into contact with the first optical member and the second oblique surface coming into contact with the second optical member.

10. The developer container according to claim 4, further comprising a gear member that includes a gear part and a transmission part capable of transmitting a power received by the gear part to the shaft, and that is turnable within a predetermined angle range between the gear part and the shaft.

11. The developer container according to claim 10, wherein the shaft includes a protrusion part that is provided at an end portion of the shaft, and that protrudes in a direction intersecting the first direction, the transmission part includes a housing part that houses the end portion, and a width, in the rotation direction of the shaft, of a portion of the housing part that houses the protrusion part is wider than a width of the protrusion part in the rotation direction.

12. An image formation unit comprising:

the developer container according to claim 1; and a development section that forms an image by using the developer contained in the container.

13. An image formation unit comprising:

the developer container according to claim 4; and a development section that forms an image by using the developer contained in the container.

14. An image formation apparatus comprising:

the image formation unit according to claim 12;

a light emitter that emits the light to be ejected from the first end face of the first optical member;

a light detector that detects the light incident on the second optical member; and a developer detector that detects, based on a detection result by the light detector, a quantity of the developer contained in the container.

15. An image formation apparatus comprising:

the image formation unit according to claim 13;

a light emitter that emits the light to be ejected from the first end face of the first optical member;

a light detector that detects the light incident on the second optical member; and a developer detector that detects, based on a detection result by the light detector, a quantity of the developer contained in the container.

16. A developer container comprising:

a container defining therein a space containing a developer;

an optical system that includes a first optical member which includes a first end face exposed to the containing space in the container, and from which light is emitted through the first end face, and a second optical member which includes a second end face exposed to the containing space and being opposed to the first end face in a first direction, and on which the light is incident through the second end face;

a shaft that is provided in the containing space, and that is rotatable about a rotation axis extending along the first direction;

a support member including: a fixed part that is fixed to the shaft; and a projected part that is projected from the fixed part in a direction substantially orthogonal to the first direction and configured to pass through a gap between the first end face and the second end face with a rotation of the shaft; and a cleaning member that is fixed to the support member, and that is configured to clean the first end face and the second end face by passing through the gap between the first end face and the second end face with the rotation of the shaft.

17. The developer container according to claim 16, further comprising:

a fixing member that presses the cleaning member against the support member and that is configured to pass through the gap between the first end face and the second end face with the rotation of the shaft.

18. The developer container according to claim 16, wherein the cleaning member is movable in the first direction along the rotation axis.

19. The developer container according to claim 16, further comprising:

a gear member that includes a gear part and a transmission part capable of transmitting a power received by the gear part to the shaft, wherein the transmission part includes a housing part that accommodates therein a protrusion part provided at an end of the shaft, wherein a width, in the rotation direction of the shaft, of a portion of the housing part that houses the protrusion part is wider than a width of the protrusion part in the rotation direction.

20. An image formation unit comprising:

the developer container according to claim 16; and a development section that forms an image by using the developer contained in the container.

21. An image formation apparatus comprising:

the image formation unit according to claim 20;

a light emitter that emits the light to be ejected from the first end face of the first optical member;

a light detector that detects the light incident on the second optical member; and a developer detector that detects, based on a detection result by the light detector, a quantity of the developer contained in the container.

* * * * *